US007493954B2

(12) United States Patent
Heller et al.

(10) Patent No.: US 7,493,954 B2
(45) Date of Patent: Feb. 24, 2009

(54) SYSTEMS AND METHODS FOR INSTALLATION, DESIGN AND OPERATION OF GROUNDWATER MONITORING SYSTEMS IN BOREHOLES

(75) Inventors: Noah Heller, Corte Madera, CA (US); Hiroyoki Atsumi, Tokyo (JP); Masaru Toida, Tokyo (JP); Toru Chino, Gilroy, CA (US)

(73) Assignees: Besst, Inc., San Rafael, CA (US); Kajima Corporation, Tokyo (JP)

( * ) Notice: Subject to any disclaimer, the term of this patent is extended or adjusted under 35 U.S.C. 154(b) by 189 days.

(21) Appl. No.: 11/178,055

(22) Filed: Jul. 8, 2005

(65) Prior Publication Data

US 2007/0007005 A1 Jan. 11, 2007

(51) Int. Cl.
*E21B 49/08* (2006.01)

(52) U.S. Cl. ..... 166/264; 166/51; 166/250.01; 166/278; 73/152.28

(58) Field of Classification Search ..... 166/264, 166/51, 278, 250.01; 73/152.23, 152.28
See application file for complete search history.

(56) References Cited

U.S. PATENT DOCUMENTS 2,776,013 A 1/1957 Tausch
3,002,828 A 10/1961 Hodges
4,475,595 A 10/1984 Watkins et al.
4,995,456 A 2/1991 Cornette et al.
5,293,931 A 3/1994 Nichols et al.
5,829,520 A 11/1998 Johnson
5,909,773 A 6/1999 Koehler et al.
6,158,516 A * 12/2000 Smith et al. ..... 166/385
6,668,943 B1 * 12/2003 Maus et al. ..... 175/5
2005/0051329 A1 3/2005 Blaisdell

* cited by examiner

*Primary Examiner*—Giovanna C Wright
(74) *Attorney, Agent, or Firm*—Roedar & Broder LLP; James P. Broder

(57) ABSTRACT

Systems and methods for installation and operation of a groundwater monitoring system in a borehole of any angle using a coaxial gas displacement pump with a unique O-ring assembly that serves as a two-position valve for groundwater purging and sampling and also as a housing and sealing mechanism for isolating an optical pressure sensor. The optical sensor measures in-situ hydraulic pressure directly subjacent and adjacent to the surrounding rock fractures and sediment pores without hydraulic interferences from potentiometric equilibration lag time from recovery fluid pressure inside a borehole, in a zone above the optical sensor, or on the inside of a riser pipe that rises to the ground surface.

39 Claims, 15 Drawing Sheets

SYSTEMS AND METHODS FOR INSTALLATION, DESIGN AND OPERATION OF GROUNDWATER MONITORING SYSTEMS IN BOREHOLES

BACKGROUND OF THE INVENTION

1. Field of the Invention

The present invention relates to monitoring underground caverns or tunnels, and more particularly, to monitoring underground hydraulic and water quality conditions within various bores extending from and located in close proximity to underground caverns and tunnels.

2. Description of the Prior Art

For the purpose of tunnel construction worker safety and post-construction structural integrity and safety, it is often desirable and required by laws, regulations, etc. to monitor hydraulic changes, which may change rapidly, in saturated fractured rock media and sediments in the earth materials surrounding these underground structures. Additionally, it may be desirable and required by laws, regulations, etc. to monitor groundwater quality within these fractured rock media and sediments. For example, underground caverns and tunnels may exist for a variety of purposes, including the storage of liquefied natural gas (LNG), storage of high level radioactive waste (e.g. spent fuel rods from nuclear power plants), mine shafts and drifts, transportation tunnels, water conduits beneath dams, etc. These caverns and tunnels may become subject to various stresses that could lead to leakage of surrounding fluids into the caverns or tunnels potentially resulting in hydraulic flooding as well as potential collapse due to various stress-related factors.

For example, there are current projects underway wherein large tunnels or caverns are being constructed below ocean floor beds, where surficial benthic sediments of the ocean floor are located at a minimum of 600 feet below ocean water. These tunnels will be used for the storage of liquefied natural gas (LNG). Hydraulic pressure from the overlying ocean water will be used to keep the gas liquefied. Large access tunnels will be constructed to reach each of the LNG tunnels. From these access tunnels, boreholes will be drilled at various angles into the surrounding rock media to monitor changes in hydraulic pressure, which can signal potential leakage of the liquefied natural gas from the storage tunnel. These monitored changes can also signal potential problems with regard to the stabilities within rock media surrounding the access tunnel, thereby indicating a potential need for worker evacuation from the access tunnels. Groundwater that moves through and around the borehole monitoring system from the surrounding rock media will be periodically tested by chemical analysis (e.g. gas chromatography, mass spectroscopy, fiber optical chemical sensor, etc.) in order to monitor LNG leakage from the storage tunnels. LNG that leaks from the storage tunnels will likely change both chemically and physically over a short period of time due to decreasing pressure and differing temperature from an immiscible liquefied phase to a dissolved aqueous phase within the surrounding groundwater fluids. These dissolved gasses can migrate through the processes of hydraulic advection and diffusion through fractured bedrock and permeable sediment to groundwater springs emerging at the ocean floor. These leaks could then dramatically affect aquatic ecology of the surrounding ocean environs and pose significant cost burden for tunnel reparations, as well as translate into replacement costs for the lost LNG. LNG leakage also poses a significant health and safety risk. As an example, dissolved aqueous phase gases can volatilize into gas phase through fractures that intersect access tunnels as well as air spaces inside various groundwater monitoring systems. If there is enough oxygen within these air spaces and pockets, explosive flashes may occur due to electrical spark, welding activity, or even heat generated from cigarette embers. Consequently, it is most critical that all of the monitoring systems throughout these tunnel environments be intrinsically safe.

Generally speaking, to monitor groundwater, boreholes, typically having a length of many hundreds of feet and more, are drilled into the ground so that water in the vicinity of the hole can seep into it. To monitor the water, probes are advanced into the hole to the desired depth where a water sample is taken and transported to the surface. Since water from different borehole depths must not be mixed, to prevent cross contamination, it is necessary to keep water from different borehole depths separate. Keeping waters from different borehole depths separate, and transporting the water to the surface, is difficult, time-consuming and costly.

Current pressure and groundwater monitoring systems are operated sequentially in terms of testing functions such as water quality and pressure. As an example, some of these systems only allow a single port in a multi-level monitoring system to be purged and sampled for groundwater at any one time. Therefore, only one port can be purged and sampled at a time. The sampling device in these systems has to be manually moved from port to port. When it is necessary to record pressure measurements, the water sampling tool must first be removed from the access pipe of the monitoring system, and then the pressure monitoring device installed through the access pipe to then obtain pressure measurements (or vice versa). This exchange of sampling and hydraulic monitoring functions is a typical practice for commercial monitoring systems. Another feature concerning conventional monitoring technologies is that groundwater sampling devices are typically characterized by valve mechanisms that can become easily jammed or clogged with sediment—adding maintenance and repair time and therefore more time and cost for obtaining groundwater samples.

Another disadvantage of conventional groundwater monitoring systems is with respect to the removal rate of "old water" from the system before each sampling event. It is a common practice to remove this old water before each sampling event so that one can be sure that the water being collected is representative of fresh formation water. As an example, some of these systems are constructed with inflatable straddle packer assemblies for isolating sampling and hydraulic monitoring zones. The packers prevent hydraulic cross communication between each sampling port. The volume of groundwater that exists between the packer assemblies is fairly large relative to the water removal rate of these sampling devices that are being used to remove the old water. The problem is exacerbated as the linear distance between the packers becomes greater. The distance between the packers is determined by various factors such as the need to average a water sample over a linear distance or the need to capture the influence of a certain fracture zone(s) between the confines of the packers so that the hydraulic properties of a particular fracture zone can be evaluated without hydraulic interference from other zones.

The conventional sampling technologies that are being used in the commercially available systems consist of sampling vials in one example and miniaturized gas displacement pumps with dual parallel tubing in another case. The sampling vial approach that is typically used consists of 250 ml containers—which can be linked together to make a four-unit interconnected vial chain. However, if the water between the packers is a large volume (e.g. 60 to 90 liters), then removal of the old water could require 60 to 90 trips in and out of the access pipe for a single purge cycle of one straddle packer volume. Given that many of these sampling ports in tunnel systems are deep with respect to ground surface and that numerous time-consuming repetitions of vial entry and removal are required during the purging process, the result is that many hours up to weeks of time may be required for purging a single port. The use of a gas displacement pump with parallel tubing is faster than the vial method in that the pump is lowered into the access pipe only one time for the purge and sampling event for a single port—and therefore avoids the in and out bailing process with sampling vials. However, being that the groundwater access pipes are typically of small diameter, the use of a parallel tube configuration with a gas displacement pump requires that the tubing for the gas-in line and the water return line are very small. Therefore, the amount of water volume storage in the two lines is very small relative to the old water volume stored between each set of straddle packers (or sandpack material surrounding the well bore). This therefore limits the amount of water volume that can be removed with each pump stroke.

With respect to groundwater sampling valve operation, the present invention is very unique in that it is much more forgiving and simple in its valve design than other prior art. Prior art valves that are used in groundwater sampling typically consist of ball valves, poppet valves, double action piston valves, one-way check valves combined with electric impellers or contracting and expanding bladders, and sophisticated mechanical valves that are opened and closed with electronically controlled tubular mechanical arms that dock with the sampling port. These devices are susceptible to plugging from water-borne sediment via intrusion into the sealing mechanisms and mechanical works inside each type of valve. Once sediment has intruded, some of these devices are difficult to clean out and repair, and may require removal of the entire monitoring system to access the impaired valve.

Accordingly, it is desirable to provide a system for monitoring various parameters such as hydraulic pressure (as well as aforementioned parameters such as temperature, eh/pH, etc.) and groundwater quality chemistry at various levels within a borehole that is simpler and more efficient.

SUMMARY OF THE INVENTION

The present invention overcomes various inefficiencies in equipment design and related costs with other commercially available underground monitoring systems. Generally, the present invention provides methods and apparatus for the installation and operation of a groundwater monitoring system in a borehole of any angle using a coaxial gas displacement pump with a unique O-ring assembly that serves as a two-position valve for groundwater purging and sampling and also as a housing and sealing mechanism for isolating an optical pressure or other type of sensor. The housing and sealing mechanism is generally referred to as a sensor isolation tip (SIT). The optical sensor measures in-situ hydraulic pressure directly subjacent and adjacent to the surrounding rock fractures and sediment pores without hydraulic interferences from potentiometric equilibration lag time from the recovery of fluid pressure inside a borehole, in a zone above the optical sensor, or on the inside of an access pipe located immediately above the SIT that rises to the ground surface.

More particularly, the present invention provides a method of monitoring a borehole defined within ground with a sensor arrangement that comprises a sensor including a filter immediately below and a riser pipe immediately above the sensor. The method includes placing at least one sensor arrangement within the borehole, surrounding the filter with a very fine-grained filter pack material, inserting the sensor into the filter through a riser pipe, and periodically testing hydraulic pressure within the surrounding borehole and earth materials arranged circumferentially around and below each sensor.

In accordance with one aspect of the present invention, the borehole may be placed angularly with respect to a bottom of a tunnel from which the borehole extends.

In accordance with another aspect of the present invention, a plurality of sensor arrangements are placed within the borehole.

In accordance with another aspect of the present invention, the method further includes moving groundwater out of the borehole past the sensor arrangement.

In accordance with a further aspect of the present invention, the very fine-grained filter pack material comprises #60 sand. In a preferred embodiment, the very fine-grained filter pack material surrounds a tubular porous sleeve that allows transfer of groundwater from the surrounding earth materials to come into contact with the sensor isolation tip. The sensor isolation tip may be pulled back slightly from a water-tight seal position, thereby allowing groundwater to pass around it and into a pipe that rises to the ground surface for obtaining water samples and pressure measurements.

In accordance with another aspect of the present invention, the sensor comprises at least one fiber optic sensor, any type of fiber optic or electrical sensor for measuring various types of water parameters such as eh/pH, temperature, dissolved oxygen, oxidation reduction potential, electrical conductivity and resistivity, as well as water quality chemistry for organic and inorganic constituents.

The present invention further provides a method of monitoring a borehole defined within ground with a sensor arrangement that comprises a sensor, where the method includes placing multiple sensor arrangements within the borehole, isolating each sensor arrangement from the other sensor arrangements with respect to the borehole and with respect to an open riser pipe, and periodically testing at least one parameter within a borehole with each sensor.

In one embodiment, each sensor arrangement further comprises a groundwater sample return line and the method further comprises periodically moving a groundwater sample through the groundwater sample return line to a sampling area.

In accordance with one aspect of the present invention, each sensor arrangement further includes a gas displacement pump containing a poppet valve assembly located immediately subjacent to each sensor arrangement for moving the groundwater sample through the groundwater sample return line when the sensor arrangement is unseated from a receiving end located at or near the bottom of a riser pipe.

In accordance with another aspect of the present invention, each sensor arrangement further comprises a dual poppet valve and gas supply line arrangement for moving the groundwater sample through the groundwater sample return line.

In accordance with a further aspect of the present invention, each sensor arrangement further comprises a gas displacement pump arrangement for moving the groundwater sample through the groundwater sample return line.

In accordance with another aspect of the present invention, each sensor arrangement is isolated from the other sensor arrangements with an inflatable packer.

In accordance with yet another aspect of the present invention, each sensor arrangement is isolated from the other sensor arrangements with alternating layers of very fine-grained filter pack material and substantially non-permeable pack material layers.

In accordance with a further aspect of the present invention, each sensor arrangement further comprises a filter and a groundwater sample return line, and the method further comprise periodically moving a groundwater sample through the groundwater sample return line to a sampling area, wherein each filter is surrounded by a very fine-grained filter pack material.

The present invention also provides a system for monitoring a borehole and the surrounding earth materials defined within the ground. The system includes a control system outside the borehole and at least one riser pipe within the borehole, each riser pipe including a filter at a distal end. A sensor arrangement is provided within each riser pipe. Each sensor arrangement includes a sensor isolation tip comprising one or more O-rings around an outer surface of the sensor isolation tip and immediately superjacent to the filter. The sensor arrangement further includes a removable sensor communicatively coupled to the control system and to a distal end of the sensor isolation tip. Finally, the sensor arrangement also includes a groundwater sample return line coupled to the sensor isolation tip and comprising at least one inlet at a distal end and outlet at a proximal end outside the borehole. A very fine-grained filter pack material is provided around each filter and adjacent walls of the borehole.

In accordance with one aspect of the present invention, a plurality of riser pipes are provided within the borehole, with each riser pipe having a different length. Additionally, the system further includes a plurality of centralizers around the riser pipes and adjacent the borehole.

In accordance with one aspect of the present invention, the plurality of riser pipes are within a range of two to ten.

In accordance with another aspect of the present invention, the very fine-grained filter pack material around each filter is separated by a substantially non-permeable pack material for hydrologically isolating monitoring zones.

In accordance with a further aspect of the present invention, the coarser non-permeable pack material comprises bentonite clay.

In accordance with another aspect of the present invention, each groundwater sample return line comprises stainless steel tubing.

In another embodiment of the present invention, a system for monitoring a borehole defined within ground includes a control system outside the borehole, at least one riser pipe within the borehole, wherein each riser pipe includes a filter at a distal end, and a sensor arrangement within each riser pipe. Each sensor arrangement includes a sensor isolation tip adjacent the filter that comprises one or more O-rings around an outer surface of the sensor isolation tip. The O-rings engage an inner surface of the riser pipe and the removable sensor is communicatively coupled to the control system and to a distal end of the sensor isolation tip. A groundwater sample return line is coupled to the sensor isolation tip and comprises at least one inlet at a distal end and an outlet at a proximal end outside the borehole. The system further includes a poppet valve arrangement coupled to the riser pipe above the sensor isolation tip that is in fluid communication with the interior of the riser pipe.

In accordance with one aspect of this embodiment of the present invention, the system includes a plurality of riser pipes and each sensor arrangement is isolated with respect to the borehole from the other sensor arrangements with an inflatable packer.

In accordance with a further aspect of this embodiment of the present invention, the poppet valve arrangement includes a pipe elbow that houses a poppet valve.

The present invention also provides a method of installing a system for monitoring groundwater pressure and quality surrounding a borehole defined within ground. The method includes providing a central pipe and at least one riser pipe arrangement to the central pipe with a centralizer. Each riser pipe arrangement comprises a riser pipe and a filter coupled to the riser pipe at a distal end. A sensor arrangement is included within each riser pipe. Each sensor arrangement comprises a sensor isolation tip that comprises one or more O-rings around an outer surface of the sensor isolation tip and adjacent to the riser pipe. The sensor arrangement further comprises a removable sensor communicatively coupled to the control system and to a distal end of the sensor isolation tip, and a groundwater sample return line coupled to the sensor isolation tip and comprising at least one inlet at a distal end and an outlet at a proximal end outside the borehole. The method includes moving the central pipe into the borehole and moving at least one riser pipe arrangement into the borehole by moving it along the central pipe. The method further includes moving a very fine-grained filter pack material through the central pipe such that it is between each filter and adjacent walls of the borehole and moving a sensor arrangement into each riser pipe. A pressurized gas is provided into each riser pipe to force groundwater therein through the at least one inlet and through the groundwater sample return line. Each sensor is communicatively coupled to a control system outside the borehole.

In accordance with one aspect of the present invention, a plurality of riser pipe arrangements are slideably coupled to the central pipe with a plurality of centralizers, with each riser pipe having a different length.

In accordance with another aspect of the present invention, the very fine-grained filter pack material around each filter is separated by a substantially non-permeable filter pack material layer, and the method further comprises moving the substantially non-permeable filter pack material through the central pipe intermittently with respect to very fine-grained permeable filter pack material.

In accordance with a further aspect of the present invention, the groundwater sample return line comprises stainless steel tubing that is stored on a spool, and the method further comprises unspooling the stainless steel tubing and moving the stainless steel tubing through a tube straightening machine after the riser pipe has been placed into the borehole.

Other features and advantages of the present invention will be apparent upon review of the following detailed description of preferred exemplary embodiments.

DETAILED DESCRIPTION OF THE INVENTION

The present invention provides systems and methods for monitoring groundwater within boreholes within the ground. Generally, the boreholes are created within rock media adjacent to manmade tunnels or caverns. Sensors are placed within access pipes (riser pipes) in the boreholes to monitor hydraulic pressure in order to sense potential changes within the ground thereby leading to potential problems with the tunnels or caverns. Additionally, groundwater samples may be obtained from the boreholes and tested for quality to watch for other potential problems, such as gas leakage or other radio activity, depending upon what is in the cavern or tunnel. For clarity and simplicity, the present invention will be described with reference to tunnels 13 that are defined or created under a minimum of 600 feet of ocean water and beneath the ocean floor. These tunnels are used to store liquefied natural gas (LNG) comprised of methane and butane. Hydraulic pressure from the ocean water column is used to keep the gas liquefied. Large access tunnels are constructed that lead to each of the LNG tunnels, from which point groundwater monitoring systems may be installed in boreholes drilled into the surrounding ground. The boreholes may spatially encircle the LNG tunnels.

Thus, the environment in which a preferred embodiment of the present invention will be described involves obtaining groundwater samples within boreholes. Water seeping into the boreholes enters riser pipes through filter portions and is purged through sample water return lines using compressed gas. Sensors are used to monitor water levels within the pipes and to monitor other parameters within the boreholes. The sensors are housed within a sensor isolation tip that also acts a plug or stopgap for allowing water into the riser pipes.

System

Figure 1:
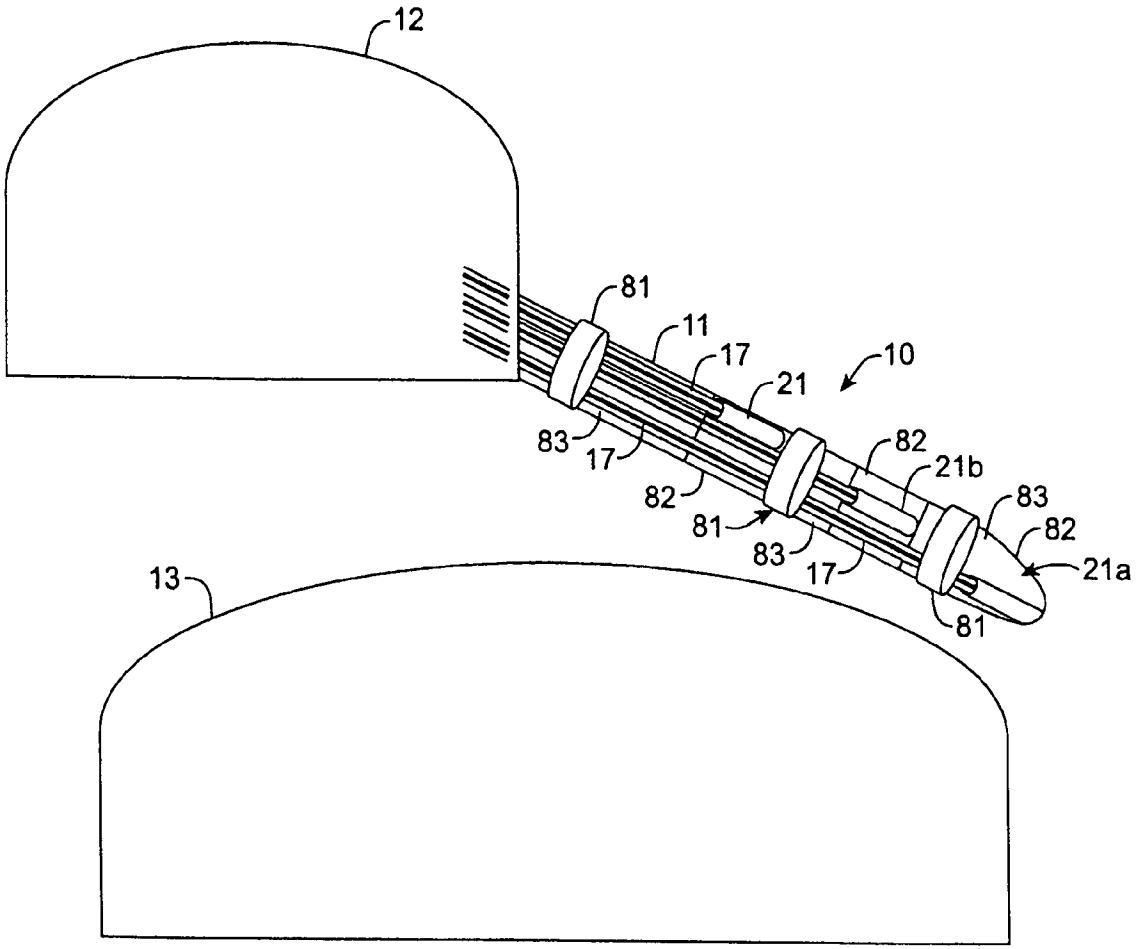
FIG. 1 is a schematic view of a borehole monitoring system in accordance with the present invention.
Figure 2:
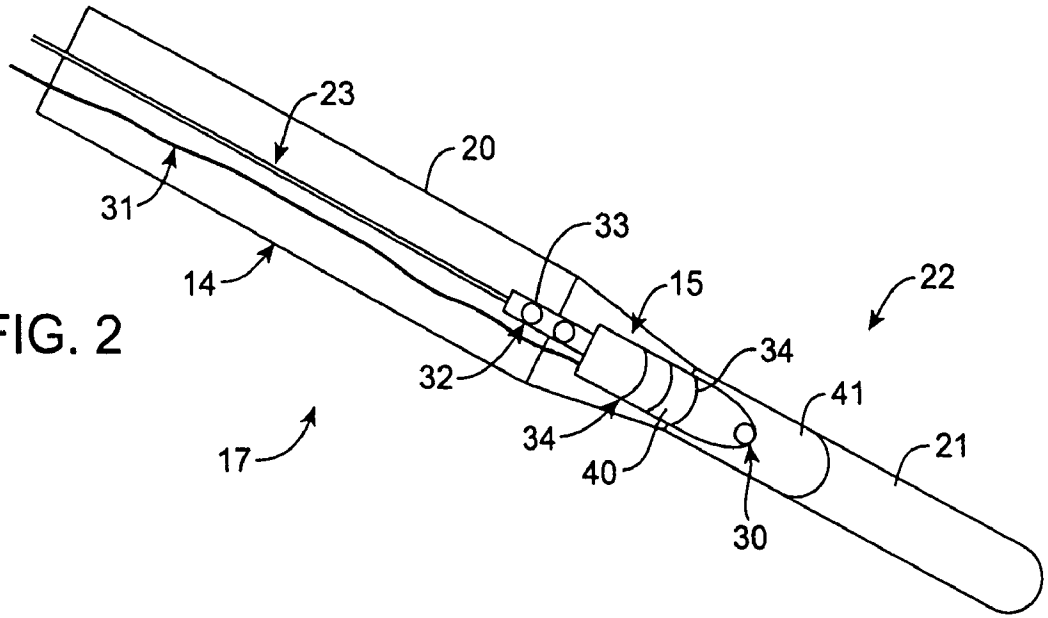
FIG. 2 is a schematic view of a coaxial gas displacement pump arrangement in accordance with the present invention.

FIG. 1 illustrates an LNG tunnel 13 and an access tunnel 12 in close proximity thereto. A borehole 11 extends from the access tunnel in order to monitor various parameters within the rock media adjacent the LNG tunnel. A groundwater monitoring system 10 is placed within borehole 11. The groundwater monitoring system is made up of a plurality of coaxial gas displacement pump arrangements 17.

With reference to the drawings, a coaxial gas pump arrangement 17 is schematically illustrated. The pump arrangement comprises a riser pipe 14 that includes a body 20 that is coupled to a filter 21 at a distal end 22. Preferably, the riser pipe is a stainless steel flush threaded pipe having sample dimensions of 18 mm OD (outer diameter) by 15 mm ID (inner diameter). A groundwater sample return line 23 is provided within the riser pipe. A sample dimension for the groundwater sample return line is 6 mm OD by 4 mm ID. The groundwater sample return line is preferably made of stainless steel tubing that is formed by a tube straightening machine during installation. The groundwater sample return line terminates with a tubular fitting 32 perforated with groundwater entry holes 33.

Figure 3:
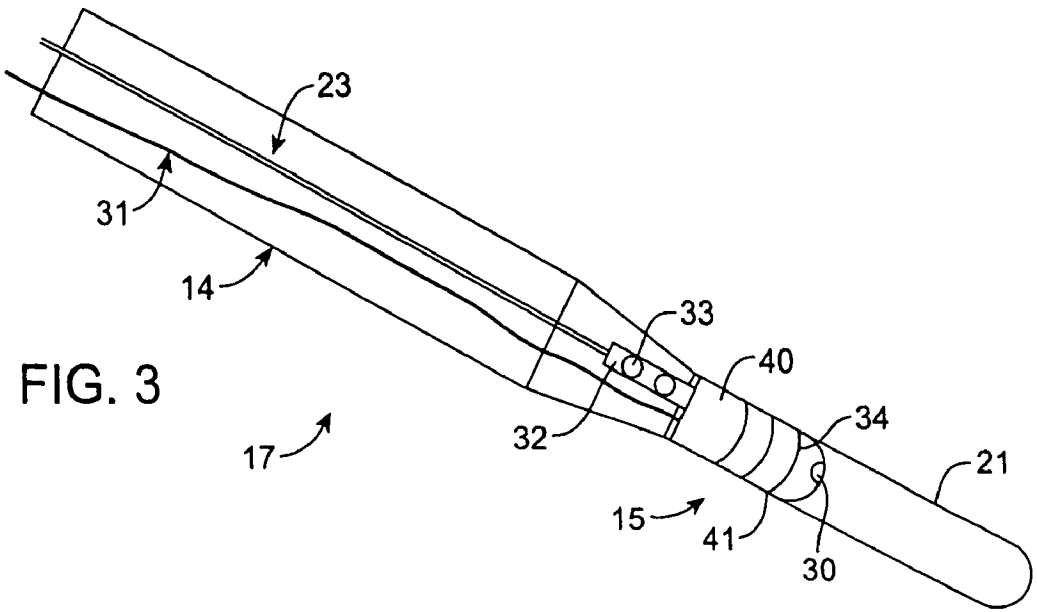
FIG. 3 is a schematic view of a coaxial gas displacement pump arrangement in accordance with the present invention illustrating a sensor isolation tip seated within a sensor isolation tip receptacle.

Each coaxial gas displacement pump further includes a sensor 30 and a sensor cable 31. Preferably, the sensor comprises a fiber optic transducer and/or other types of fiber optic sensors. In a presently preferred embodiment, the transducer is a fiber optic pressure transducer such as models FOP-M or FOP-C available from Fiso Instrument, Ltd. of Quebec City, Canada. The sensor cable comprises fiber optic cable. A sensor isolation tip 40 houses sensor 30 and is coupled to the tubular fitting. Preferably, three O-rings 34 extend around the body of the sensor isolation tip within grooves 35 formed in the tip. Thus, as may be seen in FIGS. 3 and 9, when the sensor isolation tip is in position within the riser pipe, the three O-rings provide a seal against the inside wall of an isolation tip receptacle 41 defined by the riser pipe. Body 20 of riser pipe 14 preferably tapers to define sensor isolation tip receptacle 41. Accordingly, the sensor is adjacent the filter. Sensor isolation tip 40 serves as a groundwater valve and preferably comprises stainless steel. The sensor isolation tip is directly connected to tubular fitting 32.

Figure 9:
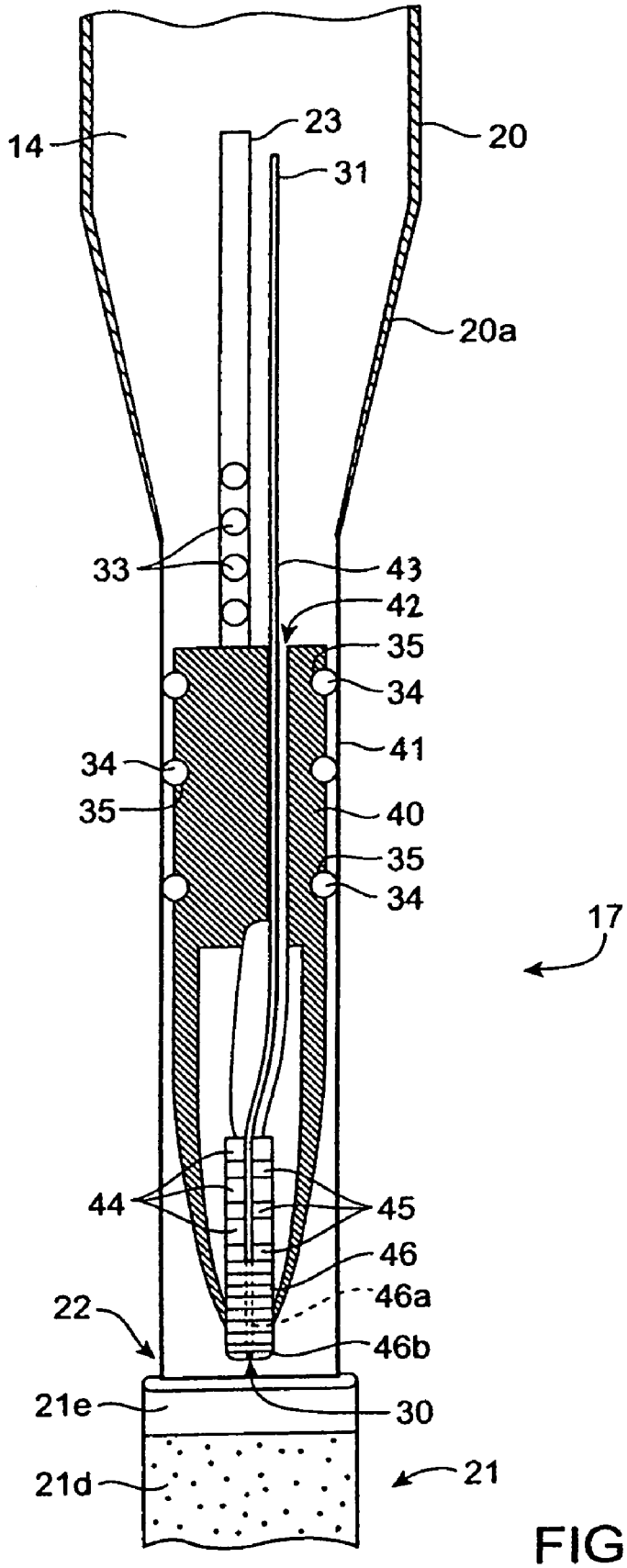
FIG. 9 is an enlarged schematic view of a sensor isolation tip.

As may be seen in FIG. 9, in a preferred embodiment, sensor cable 31 passes through an entrance 42 located at the backside of sensor isolation tip 40. A sensor cable jacket 43 is provided that is preferably made of Teflon and is approximately one millimeter in diameter. The raw fiber optic fibers, in the embodiment where sensor cable 31 is a fiber optic cable, are contained inside the jacket. The sensor cable jacket passes through a series of three O-rings 44 that alternate with three delrin washers 45. A set screw 46, bored out through its center 46*a*, is provided at the distal tip of the sensor isolation tip. The sensor cable enters and terminates in this center bore of the set screw and, thus, sensor 30 is at the distal end 46*b* of the set screw.

As the set screw is screwed into the bottom of the sensor isolation tip, O-rings 44 around the outside of the sensor cable compress the sensor cable without crushing the raw fiber optic fiber inside the cable. An air-tight and water-tight seal is thus formed above the bored-out center 46*a*, thereby isolating the very tip of sensor 30 from the riser pipe above the set screw, while there may be groundwater contact with the sensor through the bottom of the set screw through the bored-out center.

Figure 10:
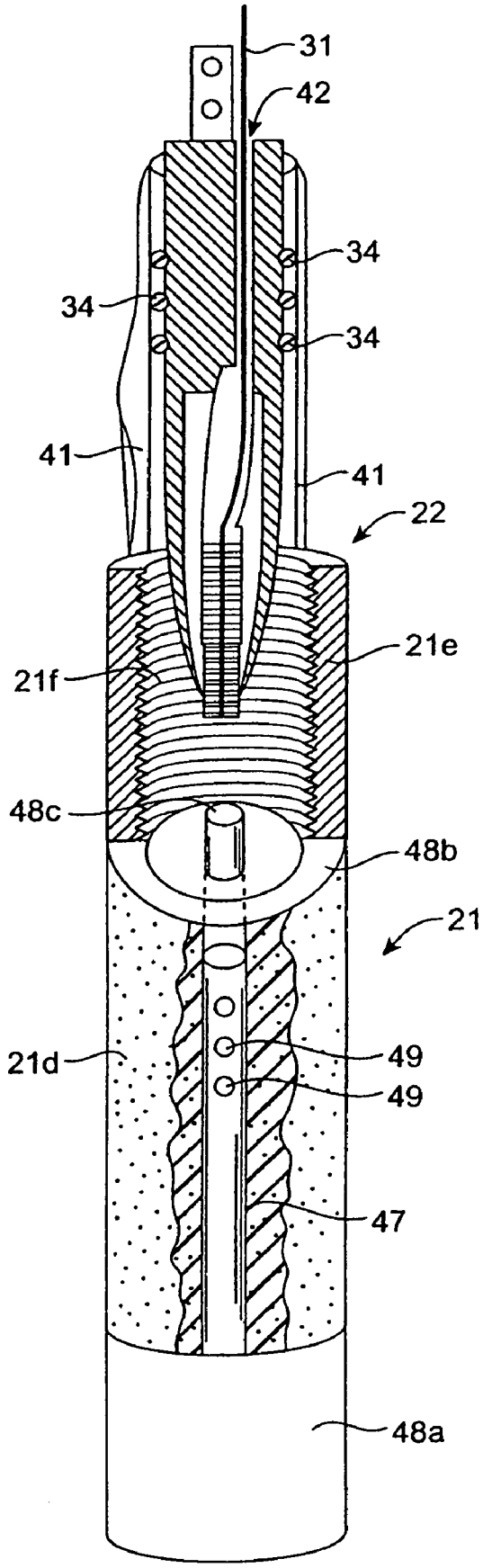
FIG. 10 is an enlarged schematic view of a filter.

As may be best seen in FIG. 10, filter 21 includes a sintered micro-porous sleeve 21*d*, made of, for example, sintered ceramic, polyethelene, Teflon or the like. The filter also includes a coupler 21*e*, a base 48*a* and a hollow internal support rod 47 that extends from base 48*a* of the filter through barrier 48*b*, with sleeve 21*d* being movably placed around the support rod. Alternatively, the sleeve may be permanently affixed to one or both of coupler 21*e* and base 48*a*.

Near the top of filter 21, the internal support rod is perforated with holes 49 to allow groundwater that passes through sleeve 21*d* to enter hollow support rod 47, pass through the hollow support rod and through exit 48*c*. The filter is coupled to sensor isolation tip receptacle 41 (not shown for clarity) at distal end 22 with coupler 21*e*. Preferably, the coupler includes threads 21*f* that cooperate with threads (not shown) on the sensor isolation tip receptacle (not shown) to couple the filter thereto. The support rod is preferably permanently affixed to the coupler at barrier 48*b* and is coupled to base 48*a* with mating threads.

Installation

Initially, the installation method for the present invention involves the use of standard drilling practice where a borehole is advanced into surrounding earth materials. The borehole may be drilled at any angle for the installation of the present invention, including upside down, at 90 degrees, or at any other inverse angle above a horizontal plane, as well as at any angle below or equal to a horizontal plane. A monitoring system in accordance with the present invention can be installed into a borehole using various techniques as a singular or multi-level groundwater monitoring system. For the latter, a plurality of coaxial gas displacement pump arrangements are placed within the borehole. If needed the borehole may be made more stable with some type of protective piping or tubing adjacent the walls of the borehole. Such protective piping or tubing would include intermittent sections of screen-type material to allow groundwater to seep past the protective piping into the borehole at the desired groundwater monitoring zones with the borehole.

Figure 4:
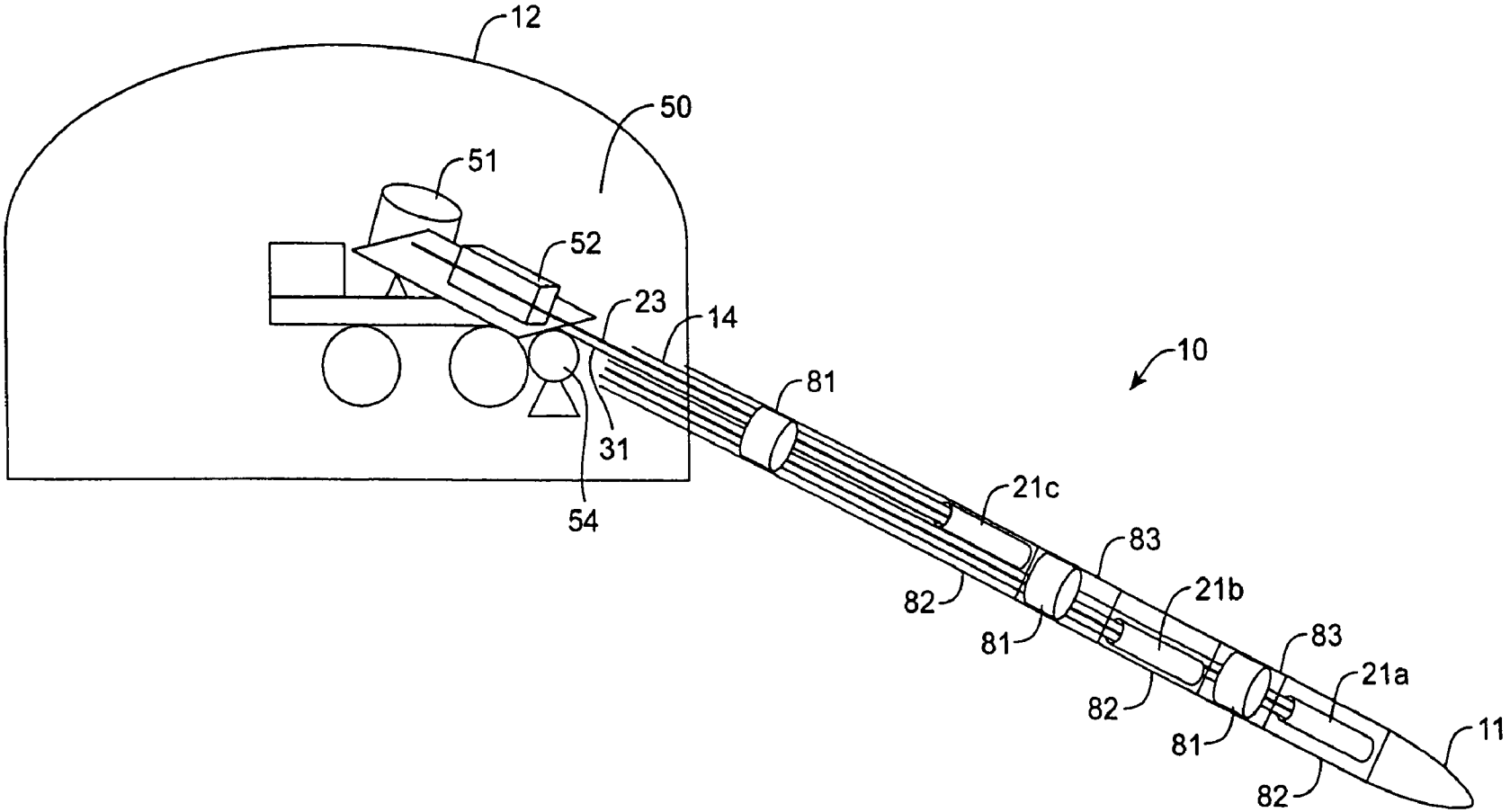
FIG. 4 is schematic view of an installation arrangement for a borehole monitoring system in accordance with the present invention.

As may be seen in FIG. 4, installation apparatus 50 for installing groundwater sample return line 23 within riser pipe 14 includes a spool 51 of stainless steel tubing, a tube straightening device 52 mounted on top of an adjustable and pivotable steel platform 53. A second spool 54 containing sensor cable 31 is provided also.

Figure 5:
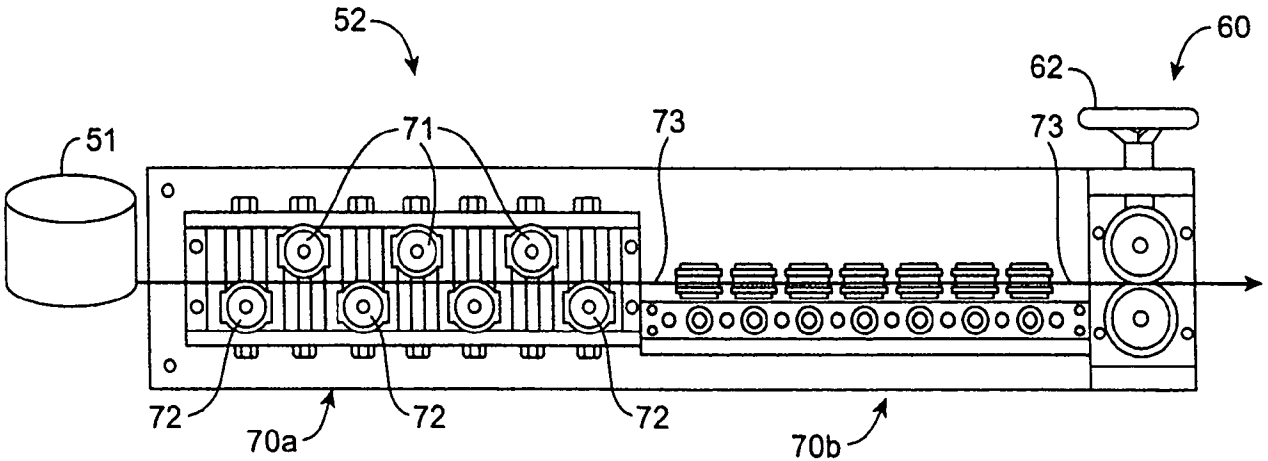
FIG. 5 is a plan view of tube straightening machine for use in installing a borehole monitoring system in accordance with the present invention.

FIG. 5 illustrates tube straightening machine 52 in greater detail. A tube puller portion 60 is located at the end opposite spool 51 of stainless steel tubing. The tube straightening machine includes two straightening sections 70*a, b*. The first section is oriented in a vertical plane with three rollers 71 on one side of tubing travel 73 and four rollers 72 on the opposite side. The second section is oriented in a horizontal plane with the same roller configuration, i.e. three rollers on one side of the flexible tubing travel 73 and four rollers on the opposite side. Thus, the stainless steel tubing enters the tube straightening machine from the spool on the side of the tube straightening machine adjacent the spool, travels through both sections of the rollers and passes through the tube puller.

Figure 6:
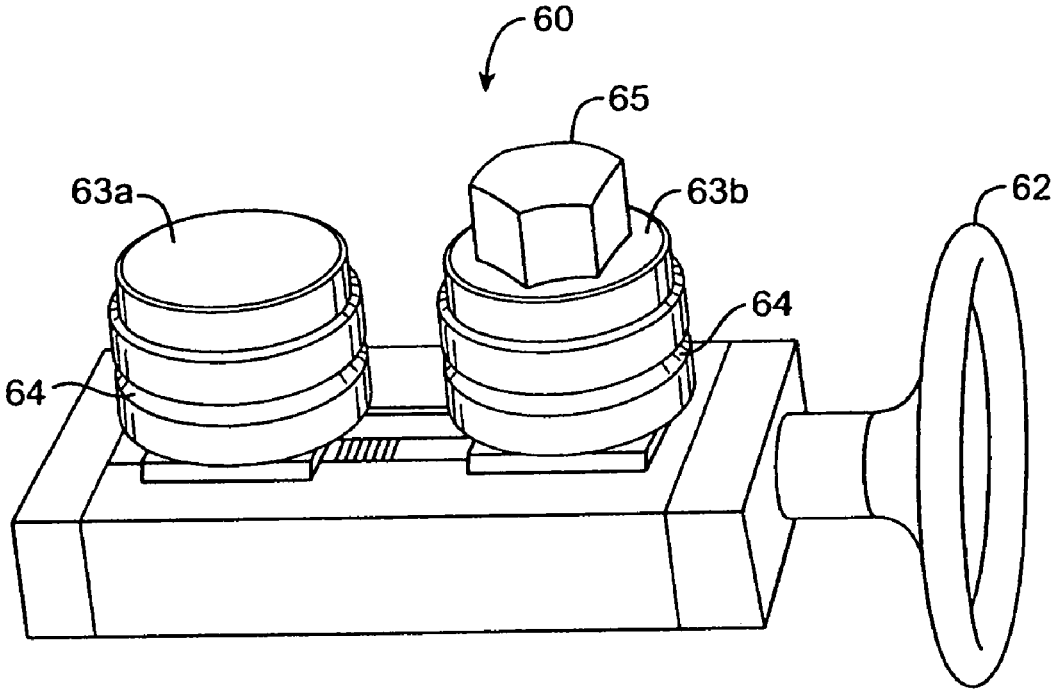
FIG. 6 is a perspective view of a tube puller portion of the tube straightening machine illustrated in FIG. 5.

FIG. 6 illustrates a tube puller portion 60 of a tube straightening machine 52 that is available from Witels Albert, Inc of East New Market, Md., and has Model No. RA7-7. An adjustment wheel 62 is provided for adjusting the space between first and second rollers 63*a, b*. Grooves 64 on the rollers are for guiding the stainless steel tube that passes through machine 52. A large hex nut 65 attached to the top of second roller 63*b* is for engagement with a large box wrench that fits around the hex nut. The box wrench handle may then be manually rotated to pull the stainless steel tubing through the tube straightening machine.

Figure 7:
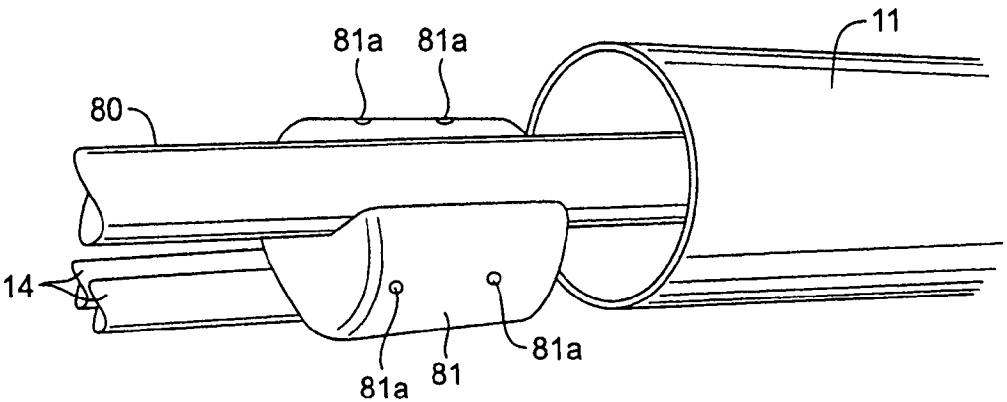
FIG. 7 is a perspective view of an installation arrangement illustrating riser pipes coupled to a central pipe.

Thus, in order to install a groundwater monitoring system 10 within a borehole in accordance with the present invention, a central pipe 80 is moved into the borehole. Riser pipes 14 with filters coupled thereto are movably attached to central pipe 80 with a centralizer 81 as may be seen in FIG. 7, with borehole 11 represented as a pipe in FIG. 7. Preferably, a centralizer is located approximately every five to 10 feet along the central pipe. The centralizers are slideably moveable along the centralizer over the central pipe. The centralizer is preferably semi-circular in cross-section where it engages the central pipe as may be seen in FIG. 7 or may be fully circular if desired. Set screws 81*a* are used to secure the riser pipes to the centralizer so that the riser pipes may be moved into the borehole by sliding the centralizer along the central pipe. As may be seen in FIG. 1, the riser pipes are staggered, such that once they are inserted into the boreholes, they will terminate at different locations along the length of the borehole at different monitoring zones. Thus, the central pipe is moved into the borehole and the riser pipes are moved into the borehole by moving the centralizers over the central pipe.

In a preferred installation embodiment, prior to installation of the groundwater sample return lines 23, sensor isolation tips 40 and sensor cable 30 into riser pipes 14, each of filters 21 are surrounded by a very fine-grained filter pack 82, preferably #60 sand. As noted previously, the filters preferably comprise a sintered porous sleeve 21*d*.

Only one sensor arrangement may be placed within a borehole if desired to form a singular groundwater monitoring system. However, the groundwater monitoring system of the present invention is especially useful for using multiple coaxial gas displacement pumps 17 within a borehole where they terminate at the varying positions or depths within the borehole as may be seen in FIGS. 1 and 4 to provide a multi-level groundwater monitoring system that may monitor groundwater from different zones within the borehole. Thus, a first filter 21*a* located at the distal end of the borehole is surrounded by very fine-grained packed material 82, such as very fine sand in a first groundwater monitoring zone. The fine sand is fed through central pipe 80 and is discharged into the borehole from the open, distal end of the central pipe so that the sand surrounds the filter, concurrently with incrementally pulling the central pipe upwards towards the ground surface as the sand is discharged to thereby fill the space between the filter and the borehole with sand and securely pack the filter in place. The central pipe is then moved further toward the ground surface, and a layer of substantially non-permeable material 83 is added through the central pipe so that it fills the space above the fine-grained pack material with substantially non-permeable material until it is close to, e.g. just below, a second filter 21*b* in a second groundwater monitoring zone that is spaced from and sealed from the first zone. The central pipe is then moved again toward the ground surface further and very fine-grained pack material is moved through the central pipe so that it surrounds this second filter and packs around the second filter against the borehole walls. The central pipe is then moved further toward the ground surface and another layer of substantially non-permeable material is added until a third filter 21*c* in a third groundwater monitoring zone is reached. This process is repeated until all filters at the varying positions within the borehole are surrounded by a very fine-grained sand material and are isolated from each other by substantially non-permeable material. Currently, the boreholes generally have a diameter that is typically in the range between about four to 12 inches, which allows up to ten coaxial gas displacement pump arrangements 17 within a borehole. In a preferred embodiment, the substantially non-permeable material comprises bentonite clay (and possibly grout if desired), which is available as benseal from Baroid, Inc. of Houston, Tex.

The collaborative mix of sand and porous filter prevents the sensor arrangements from being loaded with fine silt particles and prevents any non mobile load silt or sand-size particles from entering the riser pipes. The filters and filter-pack material only permit transfer of mobile load constituents within an aquifer. These constituents consist of colloids, particles of clay and naturally occurring organic carbon, as well as all of the natural and man-made dissolved aqueous phase and immiscible chemistry of groundwater. When the envelope of very fine-grained sand surrounds each of the filters, the diameter of-the filtering mechanism has essentially been enlarged to the diameter of the borehole. The length of the filter-packed sand column around each of the filters is determined by the end user and ultimately depends upon the length of the monitoring zone of interest. Another key point is the large amount of open surface area access for groundwater flow-through around the filter that is created by the surrounding sand envelope, as well as a significant increase in surface area (as compared to the sintered filter) to compensate for minor amounts of silt particle surface loading. Therefore, given a constant silt particle mass, the percentage of surface area loaded on a sintered filter is much greater than the surface area loaded on the enveloping sand cylinder.

Once the central pipe and the riser pipes are properly placed within the borehole and the filter pack and substantially non-permeable layers have been fed into the boreholes, sensor isolation tips 40 are advanced into their corresponding riser pipes 14. Thus, groundwater sample return line 23 is fed from spool 51 and through tube straightening machine 52, while sensor cable 31 is fed from sensor cable spool 54 into the riser pipes until the sensor isolation tips rest within their corresponding sensor isolation tip receptacle 41 within the corresponding riser pipe. The tapered section 20*a* (FIG. 9) of riser pipe 14 facilitates the insertion of sensor isolation tip 40 into receptacle 41 and the sealing of O-rings 34 against the wall of the receptacle.

The use of stainless steel tubing for groundwater sample return line 23 is preferable in order to eliminate sinusoidal bunching and surface drag that may be experienced with different types of plastic tubing during the installation process. Given that sample water return line 23 for groundwater purging and sampling is made from steel tubing, the rigidity combined with the metallurgical elasticity of the steel tube allows sensor isolation tip 40 to be easily slideably inserted with an adjustable tube straightening machine for hundreds of feet from the ground surface through a small diameter, flush threaded riser pipe that terminates with tapered sensor isolation tip receptacle 41. The bottom of the sensor isolation tip receptacle is coupled to filter 21 that allows groundwater to pass from the specific monitoring zone inside the borehole.

Thus, in summary, with a preferred embodiment of the installation method in accordance with the present invention, combinations of filling materials such as filter pack sand and bentonite materials, and grout if desired, as a means of permanently sealing each groundwater monitoring zone riser pipe and its corresponding micro-porous filter within the borehole are used. Both singular and multi-level groundwater monitoring systems 10 may be installed using a centralized monorail system in the form of central pipe 80. The central pipe is first placed into the borehole. The central pipe can be of various diameters and is also flush threaded both internally and externally. The central pipe serves two purposes. The first function is that it is used for allowing the singular or multi-level groundwater monitoring system to slide into the borehole, using cylindrical centralizers, preferably with curved underbodies that conform to the diameter of the central pipe. The centralizers also hold together the various riser pipes with the attached filters such that the pipes are spaced at a substantially fixed equilateral distance from each other during insertion of the system into the borehole as may be seen in FIG. 1.

Once the singular or multi-level monitoring system reaches the bottom of the borehole, the filling materials are introduced through the central pipe into the annular spaces between the borehole wall, and the filter and riser pipes. Very fine-grained sand (#60) is used to envelop each of the micro-porous filters and is moved into place by pouring dry sand into the central pipe through a funnel, and adding water to the funnel to wash the sand to the bottom of the central pipe. As the bottom of the borehole fills, the central pipe is slowly pulled back, being guided by the curved underbellies of the centralizers, in order to make room for the introduction of more filling materials. When the first micro-porous filter is completely surrounded by the sand, a bentonite-sand mixture is added through the central pipe as a sealing material above the previously placed #60 sand. This iterative process continues until all of the micro-porous filters are embedded in the #60 sand and a bentonite seal is placed between and above all of the sand-packed filter zones. In this manner, each sand-packed filter zone is isolated from the others such that there is no cross communication between groundwater monitoring zones within the borehole.

Figure 8:
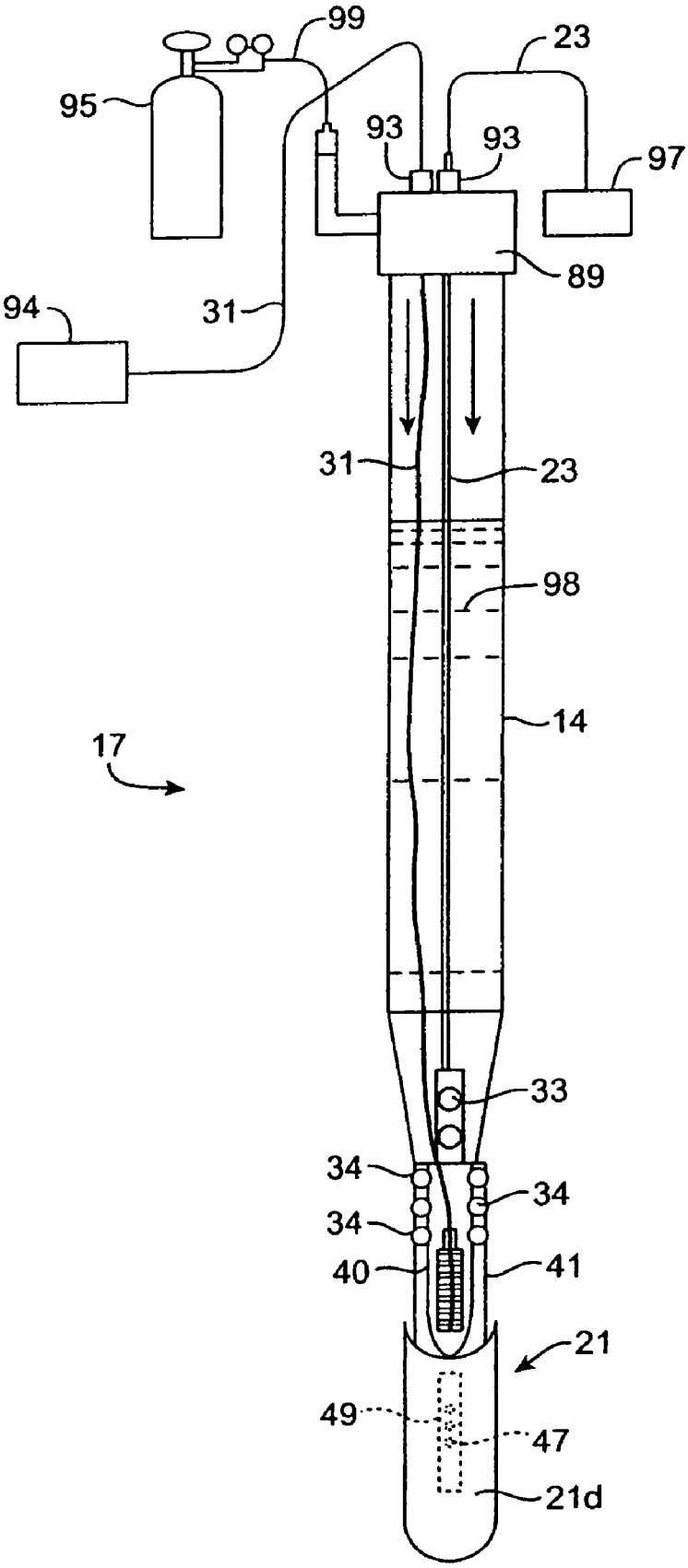
FIG. 8 is a schematic view of illustrating purging of groundwater from a riser pipe.

Once filters 21 are sealed in place, groundwater sample return lines 23, with sensor isolation tips 40 attached to the leading edge of the groundwater sample return lines, may be inserted into the riser pipes using a tube straightening machine 52 mounted on an adjustable and pivoting platform 53 that can install the stainless steel tubing at any angle. Sensor isolation tips 40 are pulled off of spool 51 and pushed into a corresponding riser pipe until the external O-rings 34 reach sensor isolation receptacle 41, where the O-rings are compressed into a water-tight seal between the sensor isolation tip and the inside wall of receptacle 41. As the sensor isolation tip is inserted, the sensor cable, which is attached to the sensor isolation tip, is concurrently fed into the riser pipe by the insertion of the rigid, stainless steel groundwater sample return line, which is also attached to the sensor isolation tip,. As shown in FIG. 8, at the ground surface, the groundwater sample return line and sensor cable exit through a manifold 89, preferably in the form of a W-shaped manifold having multiple exit ports. Each leg of the "W" has an air-tight compression fitting 93 that seals around each of the exiting lines. More exit ports may be added for additional sensor lines if desired.

Figure 12:
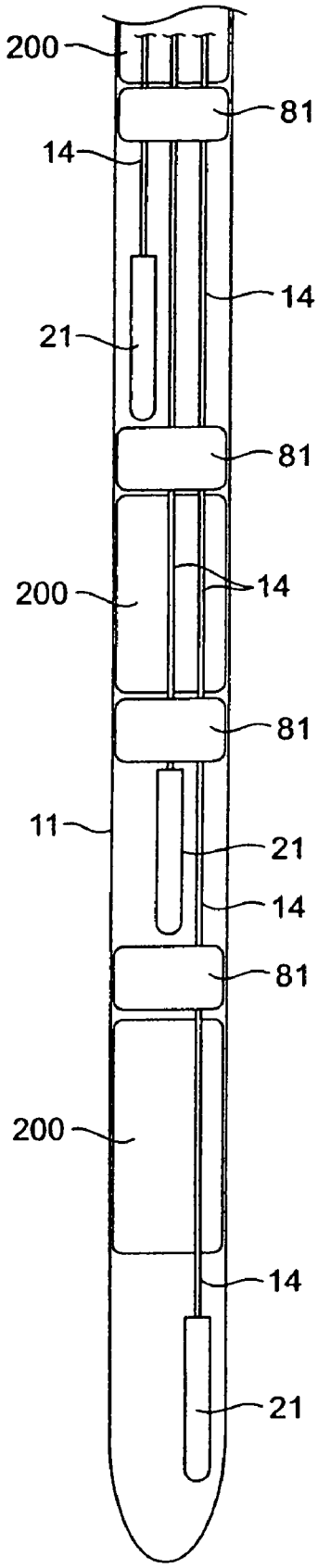
FIG. 12 is a schematic view of an alternative embodiment of a borehole monitoring system in accordance with the present invention.

With reference to FIG. 12, in an alternative installation embodiment, an inflatable straddle packer assembly 200 is used to isolate each groundwater monitoring zone as opposed to filling materials fed into the borehole through central pipe 80. This alternative embodiment allows for the removal of the entire multi-level system (riser pipes 14 and filters 21), whereas in the preferred embodiment, the riser pipe and filters are permanently sealed into place by the annular materials. The coaxial straddle-packer system (as compared to the coaxial annular material system) is also installed using a central pipe 80 as a monorail for guiding angular installations. Additionally, in this embodiment the central pipe is not required as a guide or for the introduction and delivery of annular materials. Cylindrical centralizers 81 are used in the packer approach as they are in the preferred embodiment. As in the preferred embodiment, each groundwater monitoring zone includes a riser pipe 14 coupled to a filter 21. However, the riser pipes (or tubes) are passed through each packer mandrill. In a singular installation, there is only one riser pipe passing through a packer mandrill. However, in multi-level installations, there are multiple riser pipes passing through each of the mandrills. The number of riser pipes that pass through the mandrills decreases by one with each sequentially deeper straddle packer assembly. As an example, if there are three monitoring zones, there are three riser pipes passing through the upper packer of the shallowest straddle packer assembly, two riser pipes passing through the bottom packer of the top straddle packer assembly and two riser pipes passing through the top packer of the middle straddle packer assembly, and so on, until there is only one riser pipe for the deepest straddle packer assembly. Each straddle packer assembly is inflated from an external gas source so that it tightly engages the walls of borehole 11 to isolate each groundwater monitoring zone from the other groundwater monitoring zones. When it is desired to remove the riser pipes, the necessary straddle packer assemblies are deflated.

Groundwater Purging and Sampling

With reference to FIG. 8, once all coaxial gas displacement pump arrangements 17 have been installed within the borehole, the very fine-grained pack material and the substantially non-permeable material layers have been added to the bore hole and sensor isolation tips 40 are sealingly placed within sensor isolation tip receptacles 41, the top or proximal end of each riser pipe 14 is sealed and coupled via a line 99 to a source 95 of compressed inert gas 96, such as, for example, nitrogen, or helium, or, when suitable, an air compressor. Sensor cable 31 is coupled to a computer or control system 94 for obtaining data from the sensor. Groundwater sample return lines 23 are coupled to a groundwater collection vessel 97 for receiving groundwater samples for testing purposes.

In order to purge the riser pipe of groundwater 98 that seeps into the borehole from the surrounding rock media during installation, inert compressed gas fills the air space above the water column inside the steel riser pipe. O-ring seals 34 around the sensor isolation tip prevent gas pressure from forcing the groundwater inside the riser pipe back through filter 21. Thus, groundwater present within the riser pipe is forced through inlets 33 at the bottom of the groundwater sample return line and, thus, due to pressure from the gas, is forced through the groundwater sample return line into the groundwater collection vessel.

When groundwater is required for testing at the ground surface, sensor isolation tip 40 may be pulled back with return line 23 so that the sensor isolation tip is removed from receptacle 41. This moves O-rings 34 surrounding the sensor isolation tip away from the walls within the receptacle and, thus, breaks the seal. Groundwater may then enter through filter 21 and sleeve 21*d*, entering inlets 49 of hollow internal support rod 47 and passing through exit 48*c* into the riser pipe. Once the desired amount of water is within the riser pipe, which may be sensed or measured with the sensor, the sensor isolation tip is pushed back into the sensor isolation tip receptacle with return line 23, thereby placing outer O-rings 34 in contact with the sensor isolation tip receptacle walls. This prevents further groundwater from flowing into the riser pipe. The top of the riser pipe is then sealed with compression fitting 93, and pressurized gas is fed into the riser pipe again to force the groundwater therein through inlets 33 of the groundwater sample return line and forcing the water through the groundwater sample return line to groundwater collection vessel 97 at the ground surface.

Figure 17:
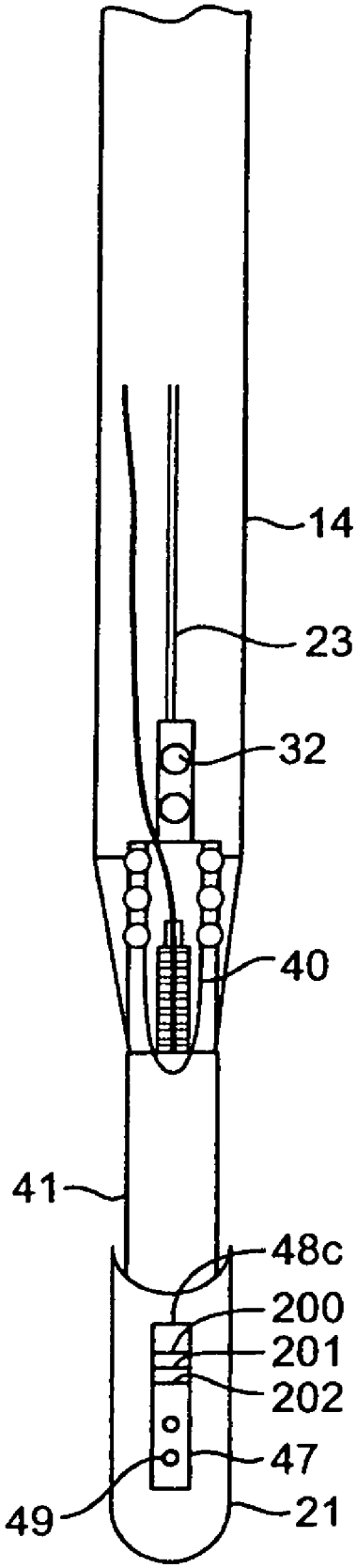
FIG. 17 is a schematic view of an alternative embodiment of the present invention.

With reference to FIG. 17, an alternative embodiment that includes a poppet valve chamber 200 located below sensor isolation tip 40 and positioned within filter 21 is illustrated. The poppet valve chamber is located along hollow support rod 47 between inlets 49 and exit 48*c*. In this alternative embodiment, the sensor isolation tip resides in the riser pipe just above sensor isolation tip receptacle 41, but is only inserted into a sealed position within the sensor isolation tip receptacle when a sensor measurement of the water in the subjacent borehole and immediately surrounding earth materials is desired. Otherwise, the sensor isolation tip remains suspended in a non-sealed position above receptacle 41 such that there is continuous hydraulic and hydrochemical communication between the riser pipe and the subjacent borehole, and thus, the surrounding earth material environment. The benefit of such a configuration is that the sensor isolation tip with connected groundwater return line 23 does not need to be pulled back from a sealed position in the receptacle to allow more groundwater to enter the riser pipe following a gas displacement purge cycle. Instead, during the purge process of any cycle, a poppet 201 inside the valve chamber seats onto an o-ring 202 located at the bottom of the valve chamber when gas pressure is applied to the fluid column inside the riser pipe. Therefore, the sealed poppet forms a blockage point to hydraulic backflow or egression of fluid with the riser pipe back into the borehole surrounding the sintered filter in a manner similar to the sensor isolation tip forming a blockage point when sealed within the sensor isolation tip receptacle as previously described. When the poppet is sealed against the valve chamber o-ring, pneumatic and hydraulic loading from the compressed gas inside the riser pipe forces the riser pipe groundwater to move through inlet holes 32 located at the distal end of sample return line 23 and then finally to an exit point at the proximal end of the sample return line where the fluid may be containerized in sample bottles or jars.

Another feature of the present invention is the ability to control coaxial gas displacement pressure in such a way during sample return that there is minimal to no loss of dissolved gases (both organic and inorganic) from solution with respect to groundwater samples. This concept is of critical importance given that the goal of water quality monitoring is to obtain substantially unadulterated groundwater samples from the formation surrounding the borehole. If the samples are allowed to depressurize during sample return and collection, then dissolved gases that might be byproducts from leaking LNG tunnels (such as butane and methane) will exolve from solution when released into an ambient atmospheric environment, whereby the overall dissolved organic gas concentration will decrease and not be representative of the water conditions in the formation around the borehole. The present invention addresses this problem in that the gas-in (or supply) pressure can be regulated as it forces groundwater to the surface through the stainless steel groundwater sample return line. At the same time, back pressure (using compressed gas) can be applied to the discharge end of the sample return line at a pressure that is slightly less than the supply pressure in order to eliminate or minimize the loss of dissolved gases.

The minimum gas pressure applied to the gas-in line that is required for lifting the groundwater to the surface can be calculated by the simple formula:

$$\text{Minimum Lift Pressure (MLP)}=[(\text{Linear Distance To O-Ring Valve From Ground Surface})/2.31\ \text{PSI/Ft.}]\times 1.1 \quad (1)$$

The MLP that should be applied to the gas-in line such that groundwater (from a specific depth below ground surface) returns to the ground surface with minimal to no loss of dissolved gases is simply defined as $MLP_{DG}$ (Minimum Lift Pressure for preserving dissolved gases) and is further defined as:

$$MLP_{DG}=n+x_1,\ \text{where } MLP=n,\ \text{and } x_1=\text{some pressure value greater than } (n). \quad (2)$$

Thus, when back pressure (BP) is applied to the groundwater discharge line in order 5 to eliminate or minimize the loss of dissolved gases, we can state that:

$$MLP_{DG} > BP \geqq MLP \quad (3)$$

The relationship assumes that there is no increase in temperature that would significantly affect the vapor pressure of the dissolved gases in the returning groundwater sample. Therefore, groundwater collection vessel 97 is preferably kept at a constant temperature that is equal to or less than the in-situ temperature of the groundwater at the specific depth of collection. This is accomplished through inclusion of a fiber optic temperature probe inside the housing of the fiber optic pressure sensor and then adjusting the temperature of the groundwater collection vessel to be equal to or less than the temperature reading from the optical temperature probe.

In this manner, a compressed gas sandwich is created on the top and bottom of the returning slug of groundwater inside the sample return line, and the sample collection vessel is maintained at the temperature of the in-situ groundwater. Given that the supply pressure is slightly greater than the back pressure, the groundwater returns slowly through the sample return line. The discharge end of the sample return line is connected directly to the distal end of the pressurized vessel. The pressurized vessel has proximal and distal switching valves attached to the container that are used to trap the groundwater sample at formation pressure and temperature when the valves are closed. The vessel is preferably made of stainless steel with a working pressure capacity greater than the formation pressure of the captured groundwater sample. Stainless steel is preferred to facilitate temperature control as well as to prevent ultraviolet radiation from breaking down organic molecules inside the chamber. The vessel can be analyzed by high pressure liquid chromatography (HPLC) or even by supercritical liquid chromatography (SCLC).

Thus, with reference to FIGS. 11A-11D, use of coaxial gas displacement pump arrangements 17 for obtaining groundwater samples may be summarized. As may be seen in FIG. 11A, a sensor isolation tip 40 is inserted into the riser pipe so that it rests within sensor isolation tip receptacle 41 and riser pipe 14 is sealed at the top as previously described. Groundwater 98 is within riser pipe 14 to a groundwater level 98*a*. As may be seen in FIG. 11B, inert compressed gas 96 is injected or released into the stainless steel riser pipe to force groundwater through groundwater sample return line inlets 33, into and through groundwater sample return line 23 and into groundwater collection vessel 97 at the ground surface, thus moving groundwater level 98*a*.

Figure 11A:
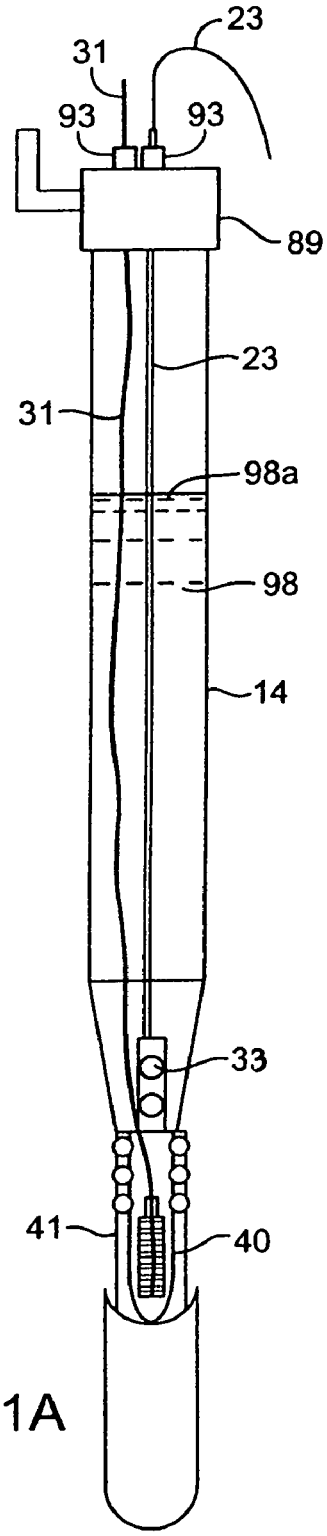
FIGS. 11A-11D are schematic views illustrating groundwater purging, groundwater sample retrieval and groundwater sample purging with a coaxial gas displacement pump arrangement in accordance with the present invention.
Figure 11B:
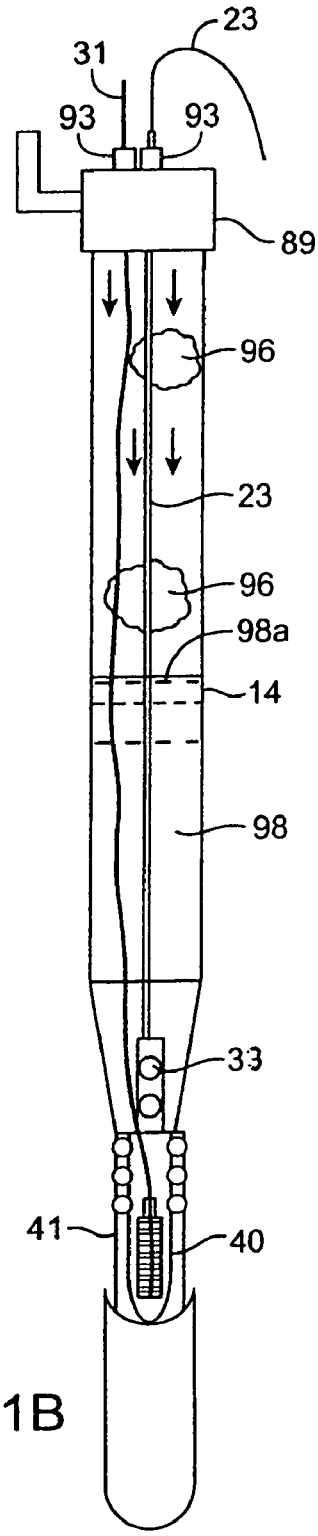
Figure 11C:
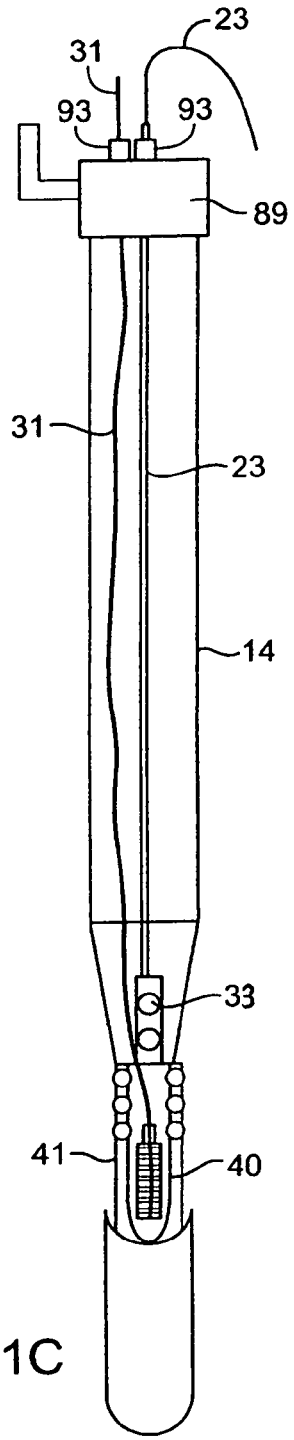
Figure 11D:
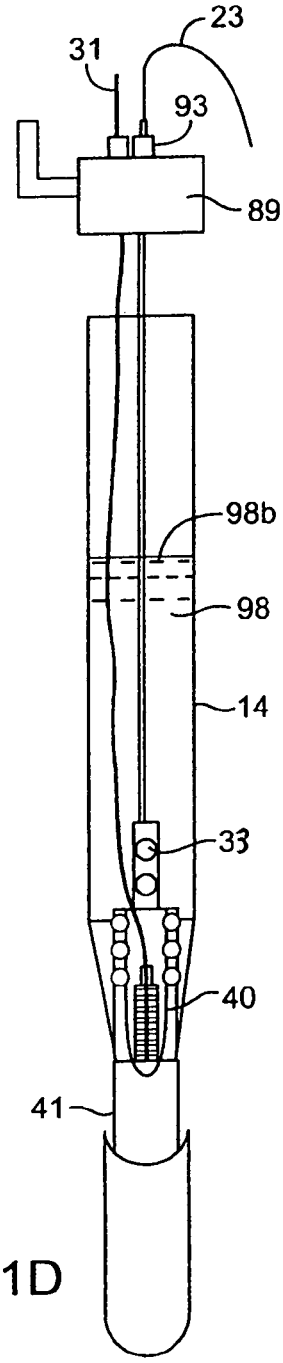

As may be seen in FIG. 11C, once all of the original groundwater has been removed from the riser pipe, sensor isolation tip 40 remains in receptacle 41 for long-term hydraulic pressure monitoring with sensor 30 in surrounding ground or earth materials. When a groundwater sample is required, the riser pipe is unsealed and the sensor isolation tip is removed from the sensor isolation tip receptacle to thereby allow groundwater to flow through the filter through sleeve 21*a* into support rod 47 and passing through exit 48*c* to the riser pipe to a desired groundwater level 98*b*. The riser pipe is then resealed and the groundwater sample is moved through the groundwater sample return line as previously described.

Figure 13:
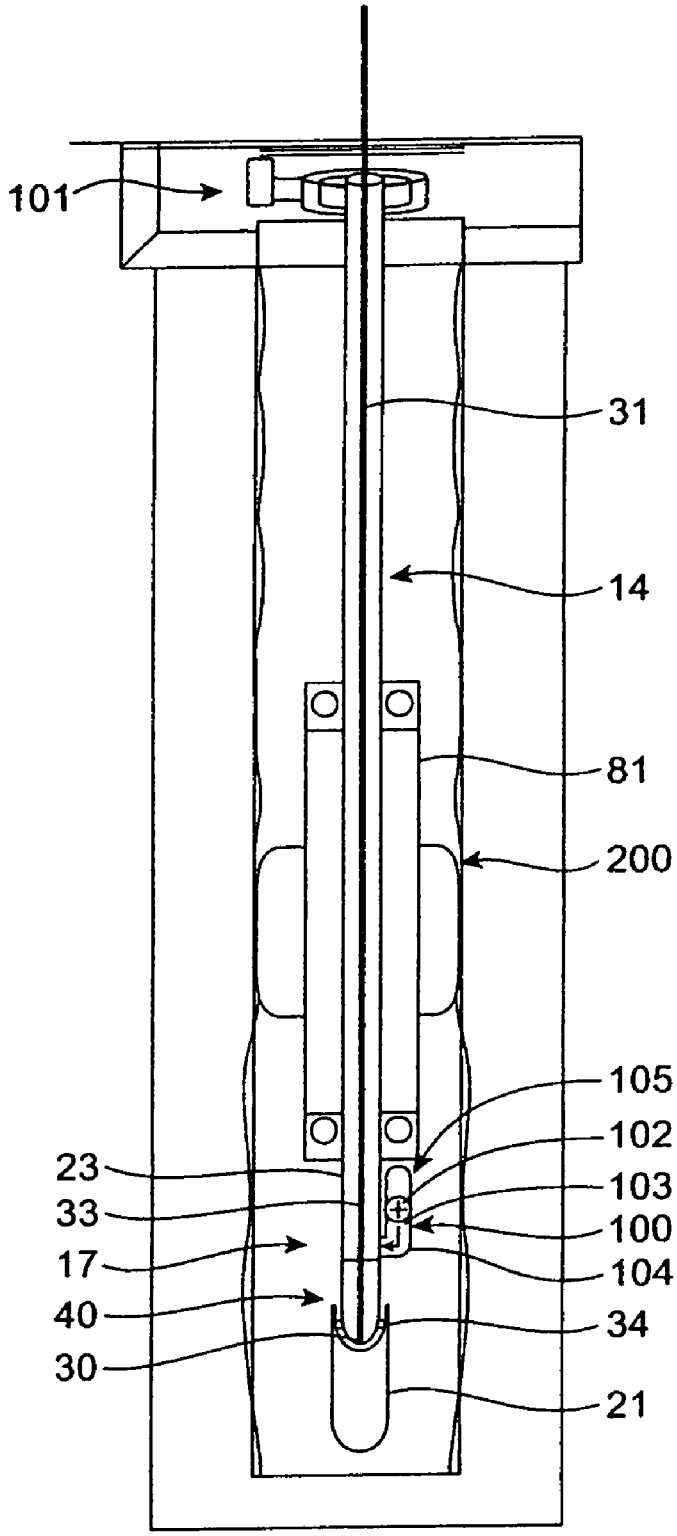
FIG. 13 is a schematic view of another alternative embodiment of a borehole monitoring system in accordance with the present invention.

FIG. 13 illustrates another alternative embodiment for the present invention. This embodiment includes a gas displacement pump arrangement 17 and a sensor isolation tip unit 40 as previously described. However, a poppet valve arrangement 100 is coupled to the riser pipe. As may be seen in the figure, the poppet valve arrangement is upside-down or inverted. Thus, FIG. 13 illustrates a gas displacement pump including an external filter 21 that preferably has a mean pore diameter of 60 microns. Sensor isolation tip unit 40 includes a sensor 30, preferably in the form of a fiber optic transducer, is seated with preferably three O-rings 34 within coaxial gas pump 17 as previously described. Groundwater sample return line 23, preferably made of stainless steel, is coupled to the sensor isolation tip. A plurality of inlet holes 33 is defined in the sample return line. Fiber optic line 31 is coupled to the fiber optic transducer. A gas port manifold 101 is provided at the top of riser pipe 14. A centralizer 81 preferably surrounds the riser pipe and a packer unit 200 is provided for isolating the filter and thereby the sensor isolation tip from the upper portion of the borehole.

When the riser pipe is pressurized as previously described, a poppet 102 in the poppet valve arrangement seats or is forced against an O-ring 103 in the upper half of the arrangement, thereby closing the poppet valve. Groundwater in the riser pipe is then forced through the water entry holes in the sample return line, thereby forcing the water through the sample return line to the ground surface as a continuous water slug until all the water from the pipe and tube is dispensed to a groundwater sampling area. The pneumatic pressure is then released at the ground surface and the poppet inside the valve chamber unseats from the O-ring. More groundwater from the isolated zone then enters through screen 105 of the poppet valve, passing through a pipe elbow 104 and through a hole defined within riser pipe 14, thereby entering the riser pipe. The pipe elbow and riser pipe are preferably coupled via an external weld.

Additionally, in this embodiment where the sensor isolation tip and the inverted poppet valve are located below a packer, the riser pipe may remain under compressed gas pressure during periods of non-operation such that there is no cross communication between the sensor isolation tip and the internal riser pipe environment. In this manner, the inverted poppet remains in a closed position on a continuous basis thereby allowing the sensor to only measure the environment in the borehole and surrounding earth materials that are located immediately below the packer assembly. When a water sample is required, the riser pipe is pressurized with compressed gas, moving the water inside the riser pipe to the ground surface. When all of the ground water is expelled from the riser pipe, the remaining compressed gas pressure is released, allowing for more groundwater from the isolated zone to pass through the inverted poppet valve and into the riser pipe. The purging and sampling cycle may be repeated as many times as necessary in order to remove old water so that fresh, representative groundwater may enter into the riser pipe for sampling. Once the purging and sampling requirements have been met, the system may remain pressurized until the next purging and sampling event such that there is no cross communication pathway between the sensor isolation tip and the inverted poppet valve.

As previously stated, the sensor isolation tip is sealed with its external O-rings within the gas displacement pump as previously described. Thus, there is no need for a poppet valve within the gas displacement pump. The filter with the diameter of 60 microns prevents silt and clay-sized particles from surface loading the sensor isolation tip and rendering the sensor isolation tip ineffective. The sensor isolation tip is isolated from groundwater in the top half of the borehole by the packer unit and from the groundwater on the inside of the riser pipe by the O-rings of the sensor isolation tip.

Figure 14:
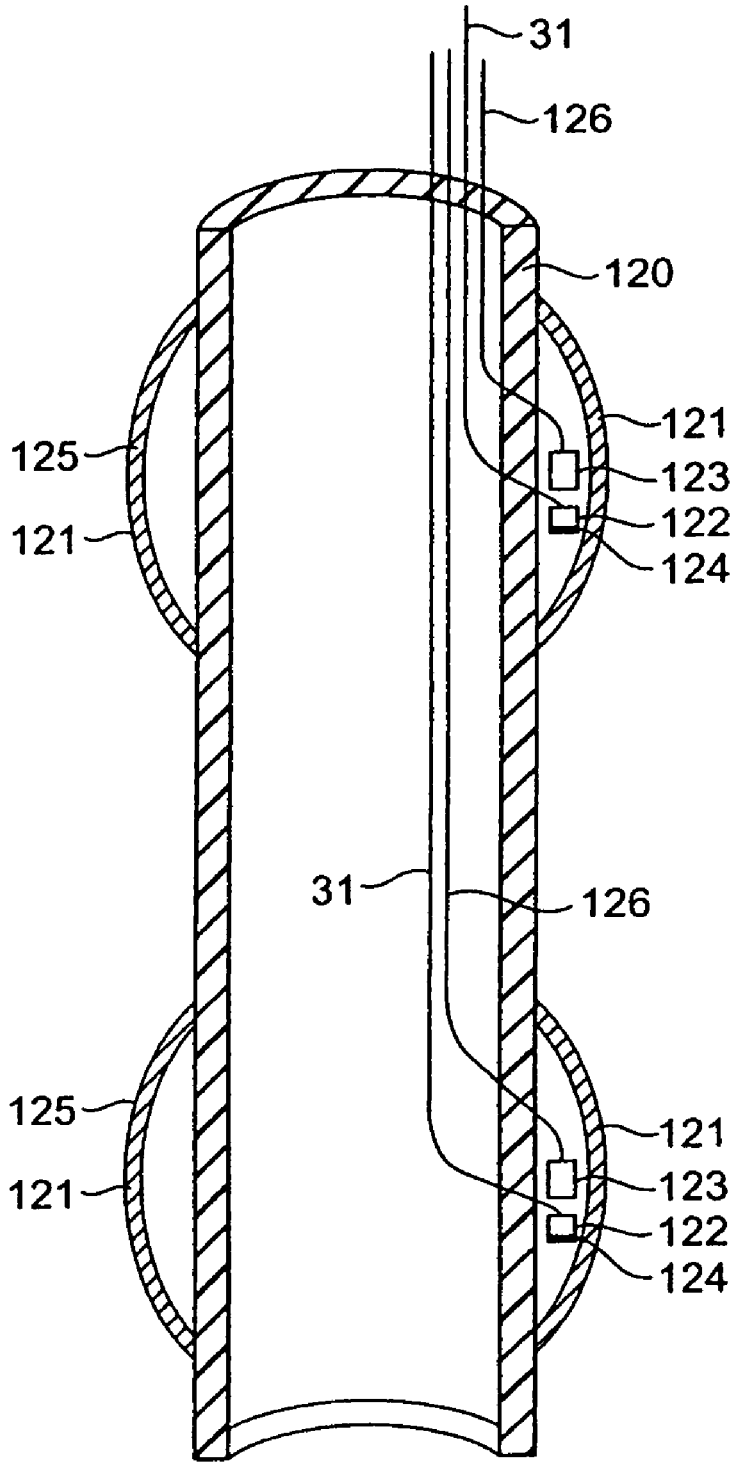
FIG. 14 is a schematic view of another alternative embodiment of a borehole monitoring system in accordance with the present invention.

FIG. 14 illustrates an alternative embodiment of a system in accordance with the present invention. The system includes a housing 120 that is preferably in the form of a pipe. A plurality of protrusions 121 are provided on the outer surface of the pipe that serve as housings 121*a* for sensor arrangements 122 and arrangements 123 for moving groundwater samples from housings 121*a* to a groundwater sampling area at the surface. Each protrusion preferably extends around the entire periphery of the pipe and is preferably coupled to the pipe with welding. Alternatively, the protrusions may be formed and defined within the surface of the pipe. The protrusion and the pipe have a space therebetween to thereby define housing 121*a* that serves as a sampling chamber as more fully described herein.

Each sensor arrangement 122 preferably includes a sensor 124, preferably in the form of a transducer, as previously described. The sensor arrangement may be placed either within the interior of the pipe or within the protrusion section.

Figure 15:
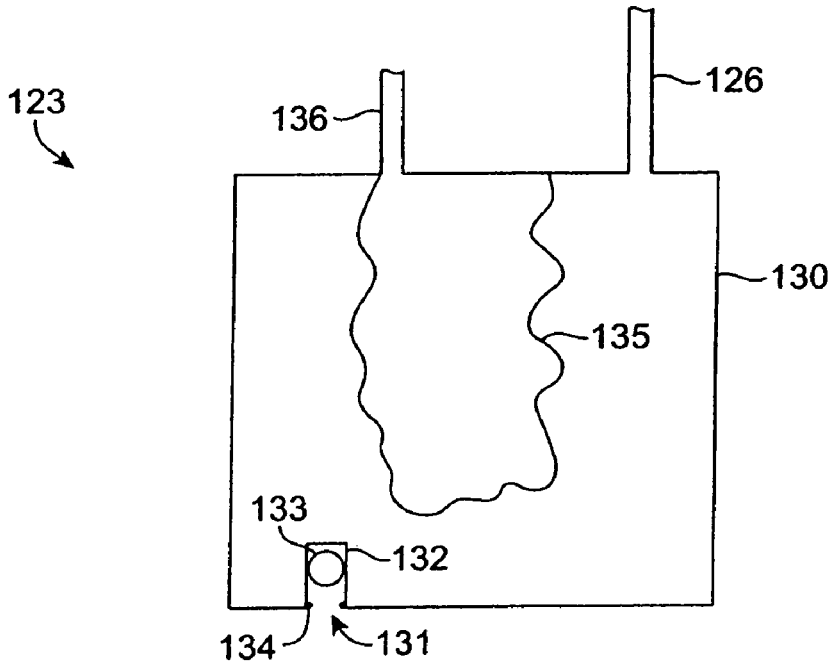
FIG. 15 schematically illustrates a bladder pump arrangement for use with the present invention.

At least a portion of each protrusion is made up of a permeable section 125 to allow groundwater into the sampling chamber defined by the protrusion. Each sampling chamber includes an arrangement 123 for moving groundwater through a groundwater sample return line 126. One arrangement is referred to in the industry as a bladder pump and is schematically illustrated in FIG. 15. The bladder pump includes a chamber 130 that has an inlet 131 controlled by a poppet valve 132. The poppet valve includes a poppet 133 that sits over the inlet. An O-ring 134 is provided to seal the poppet with respect to the inlet. A bladder 135 is provided within the chamber and a gas line 136 is coupled to the bladder. The gas line is coupled to a gas source at the surface. Thus, when in use, groundwater enters the sampling chamber and enters the bladder chamber through the poppet valve inlet. When a groundwater sample is desired at the surface, gas is provided through the gas line to the bladder, thereby inflating the bladder. This exerts pressure on the water, thereby closing the poppet valve by causing the poppet to seat against the O-ring over the inlet. Now the only place for the water to go as the bladder expands is through the groundwater sample return line. Thus, the groundwater sample is moved to the groundwater sampling area at the surface. Once the groundwater sample is obtained, the gas is removed from the bladder, thereby causing it to deflate. This allows for groundwater to enter into the chamber through the poppet valve inlet since the reduced pressure allows the poppet to unseat itself from the O-ring.

Figure 16:
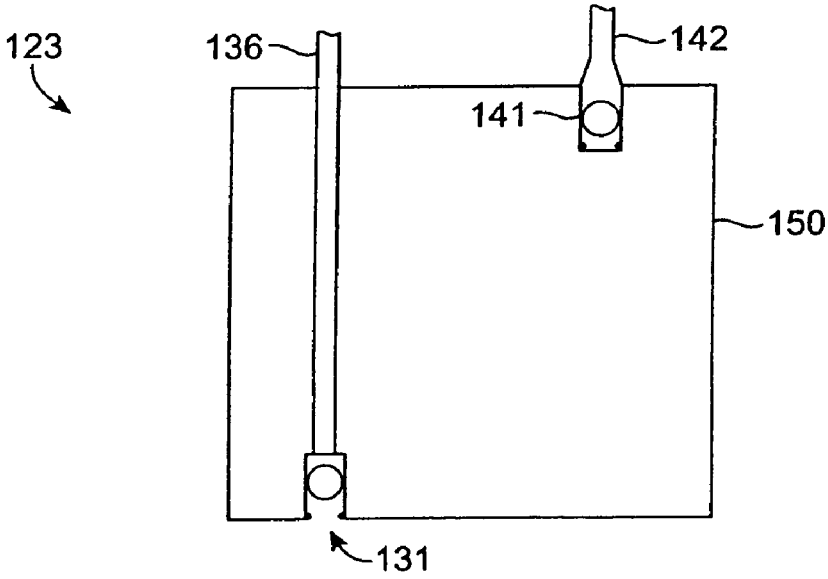
FIG. 16 schematically illustrates a dual poppet valve arrangement for use with the present invention.

In another embodiment, arrangement 123 for removing the groundwater sample from housings 121*a* consists of a dual poppet valve arrangement that is schematically illustrated in FIG. 16. In this arrangement, a poppet valve 140 is placed at the end of the gas pressure line and a second poppet valve 141 is placed along groundwater sample return line 142. Groundwater seeps into the sampling chamber and passes through the first poppet valve up into the gas pressure line and chamber 130. When a sample is desired, gas pressure is applied to the gas pressure line, thereby causing the first poppet valve to seat. This forces the ground sample water up the groundwater sample return line through the second poppet valve.

In a third embodiment, a coaxial gas pump 17, as previously described, is used for arrangement 123 for moving ground sample water. The gas displacement pump is placed within the sampling chamber and includes a screen for allowing ground water sample to enter the housing or riser pipe for the gas displacement pump. When a sample of groundwater is desired, pressure is applied to the gas displacement pump through the gas pressure line, thereby causing the groundwater sample to move through the groundwater sample return line to the groundwater sampling area. Thus, the gas displacement pump may include a sensor isolation tip-type arrangement as previously described herein for controlling the groundwater sampling. Alternatively, a poppet valve may be placed at the bottom of the gas displacement pump.

Thus, this embodiment of the present invention that includes the sampling chambers allows for the groundwater sampling items to be placed slightly outside the primary portion of the pipe, thereby allowing for the cables, gas lines, and groundwater sample return lines to pass more freely within the main or central portion of the pipe. This arrangement allows for more sensor arrangements and also allows for a longer and deeper system overall within the borehole.

Each protrusion section and sensor arrangement therein is isolated from other protrusion sections and sensor arrangements by either inflatable packers or with alternating layers of packing material as previously described herein.

Thus, the present invention is used to monitor hydraulic pressure within the rock media surrounding LNG tunnels and associated riser tunnels using boreholes. The present invention is also used to obtain samples of groundwater from the boreholes to test for potential leakage from the LNG tunnels. Those skilled in the art will understand that the present invention may be used to monitor hydraulic pressure within rock media and obtain groundwater samples for other applications.

Accordingly, the groundwater monitoring system in accordance with the present invention uses coaxial gas displacement pumps with a unique O-ring assembly that serves as a two-position valve for water quality purging and sampling and also as an external sealing mechanism for isolating an optical pressure sensor. The sensor, preferably in the form of a fiber optic transducer, measures in-situ hydraulic pressure directly adjacent to the surrounding rock fractures and sediment pores without hydraulic interference from potentiometric equilibration lag time from recovery fluid pressure inside a borehole or pipe. As an example, if water inside a vertically buried pipe is removed, and then allowed to recharge through a well screen or filter at the bottom end of the pipe, a certain amount of time is required for the water pressure to recharge inside the pipe (through the well screen) such that the water pressure outside the well screen is equal to the water pressure (or potential) inside the pipe. The recovery time is referred to as the potentiometric equilibration lag time. It is important to note that in the linear sequence of hydraulic recovery due to changes in hydraulic pressure (either natural or anthropogenic), the water around the well screen is first to respond followed by changes onside the pipe in the section above the well screen. If one is able to seal off the well screen area with a packer or O-ringed device and place a pressure measuring device within the sealed-off well screen area, then the pressure measurements would only be reflective of hydraulic changes immediately outside the screened area and not inside the well pipe above the screened section of the well. This concept is important to monitoring of rapid hydraulic changes during tunnel construction, such that rapid changes may be indicative of pending hydraulic blow-outs and massive leaks within the tunnel construction zone and structural instabilities in the completed underground structures.

Accordingly, the present invention provides many unique features that streamline the problems described with respect to other systems used for the monitoring process. As an example, the present invention does not require an exchange of groundwater sampling and hydraulic monitoring equipment for sampling and hydraulic data collection. All of the equipment remains together inside the groundwater riser pipe at the same time, and all of the pump arrangements and sensors can be used at the same time. Also, old purge water can be removed quickly due to the coaxial relationship between the groundwater return line and the riser pipe. Therefore, large volumes of groundwater can be removed quickly with each pump stroke.

More specifically, the groundwater sampling device and pressure sensors (or any other type of sensor) can exist and operate at the same time in the riser pipes that lead to and terminate with each of the filters within each monitoring zone. This is accomplished through the unique design of the inventive monitoring system. Therefore, if desired, all of the groundwater monitoring zones can be purged and sampled at the same time (in parallel), and concurrently with functioning sensors in the riser pipes. Additionally, all of the sensors are installed in such a way that they are physically independent of each other. Therefore, if one sensor fails or malfunctions, the failure of that sensor will not affect any of the other sensors. This is not the case in some of the other commercially available technologies where each sensor in a sensor array is electrically linked in series with each other. Therefore, in the past, failure of one sensor may adversely impact some or even all of the other sensors.

A unique monitoring system design in accordance with the present invention is referred to as a parallel functioning system compared to the other technologies that are referred to as sequentially functioning (or in-series) systems. As a result of this unique design, the present invention also has the ability to include other types of miniaturized optical sensors, either independently or in combined arrays in simultaneous fashion with the groundwater sampling function, with all components operating concurrently. These optical sensors (and electrical sensors if desired) may include, but are not limited to, measurement of pressure, temperature, dissolved oxygen, eh/pH, oxidation-reduction potential (ORP or Redox), electrical conductivity and resistivity and various types of organic and inorganic chemical compounds.

The sensors used with the present invention have the distinct advantage that they are easily removable from each sensor cable that connects each sensor with an up-hole data logger. Therefore, the sensor can be easily replaced in the field without having to send an entire sensor and cable assembly back to the manufacturer for repair or recalibration. Electrical sensors used in conventional prior art technology are hard-wired to the sensor cable and therefore require that the entire sensor and cable assembly be sent back to the manufacturer for repair or recalibration.

Another advantage of the present invention is that it may be installed and operated at any angle extending from within and around tunnels or other types of industrial features. As an example, the current invention can be installed and operated within a borehole horizontally, upside down, and at any positive or negative angle extending from and surrounding a tunnel or other type of industrial feature. Prior art monitoring technologies are much more limited in terms of installation angles in that they can only be installed and operated at limited angular departures from a vertical orientation.

Thus, the present inventive system has linear flexibility such that the invention can sinuously conform as it is being installed into curved boreholes and curvatures in underground pipes. This feature overcomes the problem of having to drill a perfectly straight borehole (an almost impossible task) to accommodate the installation of various types of underground monitoring systems.

Another feature of a preferred embodiment of the present invention is that it is intrinsically safe in its entirety within the borehole environment. Compressed inert gas is used to operate the pumping mechanism that allows the collection of water quality samples. Water pressure is measured with fiber optic pressure transducers using light travel return times for measuring pressure fluctuations as opposed to down-hole electrical impulse and vibrating wire sensors used in other systems. This feature is of critical safety importance with respect to monitoring LNG tunnels, coal-bed methane reservoirs, and underground gas emissions of methane and hydrogen gas bearing compounds from surrounding earth materials. Additionally, the seal formed by the O-rings with the wall of the isolation tip receptacle provides a water-tight seal between the sensor isolation tip and the sensor isolation tip receptacle. This seal isolates the fiber optic transducer stored in the end of the sensor isolation tip. When the fiber optic transducer is isolated, water pressure may be monitored directly in the surrounding rock fractures and/or sediment bores surrounding the borehole, without hydraulic pressure interference from groundwater inside the riser pipe. This isolation of the fiber optic transducer eliminates lag time for hydraulic equilibrium to be achieved in the steel riser pipe, and therefore, provides more up-to-the-minute pressure change data in the surrounding rock material. Timely hydraulic measurements are necessary for safety during tunnel construction and provide real-time data on leakage of liquefied natural gas from the liquefied natural gas tunnels.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A method of monitoring a borehole defined within ground with sensor arrangements, the method comprising:

providing the borehole;

providing a central pipe;

providing at least one riser pipe arrangement comprising:

a riser pipe;

a filter at a distal end of the riser pipe;

a sensor arrangement within the riser pipe, the sensor arrangement comprising:

a sensor isolation tip adjacent the riser pipe and comprising one or more O-rings around an outer surface of the sensor isolation tip adjacent an inner wall of the riser pipe;

a sensor at a distal end of the sensor isolation tip and communicatively coupled to a control system; and a groundwater sample return line coupled to the sensor isolation tip and comprising at least one inlet at a distal end and an outlet at a proximal end outside the borehole;

moving the central pipe into the borehole;

guiding the at least one riser pipe arrangement with a centralizer along the central pipe into the borehole;

moving a very fine-grained filter pack material through the central pipe such that it is around each filter and an adjacent wall of the borehole;

providing a pressurized gas into each riser pipe to force groundwater therein through the at least one inlet and through the groundwater sample return line;

periodically testing hydraulic pressure within the borehole with each sensor;

periodically providing a pressurized gas into a selected riser pipe to force groundwater therein through the at least one inlet and through the groundwater sample return line; and testing groundwater obtained from the groundwater sample return line;

wherein prior to directing the pressurized gas into the selected riser pipe, the sensor isolation tip is moved to allow groundwater to enter the selected riser pipe through the filter.

2. A method in accordance with claim 1, wherein a plurality of riser pipe arrangements are provided and a plurality of riser pipes are guided along the central pipe with a plurality of centralizers, each riser pipe having a different length, and wherein the very fine-grained filter pack material around each filter is separated by a substantially non-permeable pack material layer, the method further comprising moving the central pipe in stages out of the borehole and moving the substantially non-permeable pack material through the central pipe intermittently with very fine-grained pack material.

3. A method in accordance with claim 1 wherein a plurality of riser pipes are coupled to the central pipe with a plurality of centralizers, each riser pipe having a different length.

4. A method in accordance with claim 1 wherein the very fine-grained filter pack material around each filter is separated by a substantially non-permeable pack material layer and the method further comprises moving the central pipe in stages out of the borehole and intermittently moving the substantially non-permeable pack material through the central pipe intermittently with very fine-grained pack material.

5. A system for monitoring a borehole defined within ground, the system comprising:

a control system outside the borehole;

at least one riser pipe within the borehole, each riser pipe having a filter at a distal end;

a sensor arrangement within each riser pipe, each sensor arrangement comprising:

a sensor isolation tip adjacent the filter and comprising one or more O-rings around an outer surface of the sensor isolation tip, the O-rings engaging an inner surface of the riser pipe;

a removable sensor communicatively coupled to the control system and to a distal end of the sensor isolation tip; and a groundwater sample return line coupled to the sensor isolation tip and comprising at least one inlet at a distal end and an outlet at a proximal end outside the borehole: and a very fine-grained filter pack material around each filter and adjacent walls of the borehole.

6. A system in accordance with claim 5 wherein the very fine-grained pack material comprises #60 sand.

7. A system in accordance with claim 5 wherein the sensor comprises a fiber optic transducer.

8. A system in accordance with claim 5 wherein the sensor comprises an electrical transducer.

9. A system in accordance with claim 5 wherein the borehole is oriented angularly with respect to a bottom of a tunnel from which the borehole extends.

10. A system in accordance with claim 5 wherein the very fine-grained filter pack material around each filter is separated by a substantially non-permeable pack material layer.

11. A system for monitoring a borehole defined within ground, the system comprising:

a control system outside the borehole;

a plurality of riser pipes within the borehole, each riser pipe having a different length, each riser pipe having a filter at a distal end;

a sensor arrangement within each riser pipe, each sensor arrangement comprising:

a sensor isolation tip adjacent the filter and comprising one or more O-rings around an outer surface of the sensor isolation tip, the O-rings engaging an inner surface of the riser pipe;

a removable sensor communicatively coupled to the control system and to a distal end of the sensor isolation tip; and a groundwater sample return line coupled to the sensor isolation tip and comprising at least one inlet at a distal end and an outlet at a proximal end outside the borehole;

a very fine-grained filter pack material around each filter and adjacent walls of the borehole; and a plurality of centralizers around the riser pipes and adjacent the borehole.

12. A system in accordance with claim 11 wherein the number of riser pipes are within a range of two to ten.

13. A system for monitoring a borehole defined within ground, the system comprising:

a plurality of sensor arrangements each including (i) a sensor for monitoring at least one parameter within the borehole, (ii) a groundwater sample return line, and (iii) an arrangement for moving a groundwater sample through the groundwater sample return line to a sampling area, each sensor arrangement being isolated from the other sensor arrangements with respect to the borehole; and a housing including a pipe having an outer surface and a plurality of protrusions on the outer surface, at least a portion of each protrusion being permeable and serving as a filter, wherein each sensor arrangement is housed within one of the protrusions.

14. A system for monitoring a borehole defined within ground, the system comprising:

multiple sensor arrangements each comprising a sensor for monitoring at least one parameter within the borehole, each sensor arrangement being isolated from the other sensor arrangements with an inflatable packer; and a housing including a pipe having an outer surface and a plurality of protrusions on the outer surface, at least a portion of each protrusion being permeable and serving as a filter, wherein each sensor arrangement is housed within one of the protrusions.

15. A system for monitoring a borehole defined within ground, the system comprising:

multiple sensor arrangements each comprising a sensor for monitoring at least one parameter within the borehole, each sensor arrangement being isolated from the other sensor arrangements with alternating layers of very fine-grained filter pack material and substantially non-permeable pack material layers,; and a housing including a pipe having an outer surface and a plurality of protrusions on the outer surface, at least a portion of each protrusion being permeable and serving as a filter, each filter being surrounded by very fine-grained filter pack material wherein each sensor arrangement is housed within one of the protrusions.

16. A method for monitoring a fluid within a borehole, the method comprising the steps of:

guiding movement of a centralizer secured to a first riser pipe and a first filter within the borehole with a central pipe positioned within the borehole;

moving a first filling material through the central pipe to fill a space between a wall of the borehole and the first filter; and guiding a second riser pipe and a second filter into place within the borehole with the centralizer that moves along the central pipe.

17. The method of claim 16 wherein the steps of guiding the first riser pipe and guiding the second riser pipes occur simultaneously.

18. The method of claim 16 wherein the first filter and the second filter are positioned at different depths within the borehole.

19. A method for monitoring a fluid within a borehole, the method comprising the steps of:

guiding movement of a centralizer secured to a first riser pipe and a first filter within the borehole with a central pipe positioned within the borehole; and moving a first filling material through the central pipe to fill a space between a wall of the borehole and the first filter, the first filling material including a water permeable material; and moving a second filling material through the central pipe to fill a space between a wall of the borehole and the first riser pipe.

20. The method of claim 19 wherein the second filling material includes a substantially non-permeable material.

21. A method for monitoring a fluid within a borehole, the method comprising the steps of:

guiding movement of a centralizer secured to a first riser pipe and a first filter within the borehole with a central pipe positioned within the borehole;

moving a first filling material through the central pipe to fill a space between a wall of the borehole and the first filter; and forming a water-tight seal between a sensor isolation tip and an inner wall of the riser pipe with an O-ring.

22. The method of claim 21 further comprising the step of positioning a pressure sensor adjacent to the sensor isolation tip.

23. The method of claim 21 wherein the step of forming a water-tight seal includes pushing the sensor isolation tip into position with a rigid sample return line.

24. The method of claim 23 further comprising the step of positioning the riser pipe at a non-vertical angle.

25. A method for monitoring a fluid within a borehole, the method comprising the steps of:

guiding movement of a centralizer secured to a first riser pipe and a first filter within the borehole with a central pipe positioned within the borehole, the central pipe being fixed relative to the borehole; and moving a first filling material through the central pipe to fill a space between a wall of the borehole and the first filter.

26. The method of claim 25 further comprising the step of moving a second filling material through the central pipe to fill a space between a wall of the borehole and the first riser pipe.

27. A system for monitoring a fluid within a borehole having a wall, the system comprising:

a first riser pipe positioned within the borehole;

a first filter coupled to the first riser pipe;

a first filling material;

a centralizer that is secured to the first riser pipe;

a central pipe positioned within the borehole, the central pipe guiding movement of the first filling material relative to the first filter, the central pipe guiding movement of the centralizer to position the first riser pipe within the borehole; and a second riser pipe that is secured to the centralizer so that movement of the centralizer positions the second riser pipe within the borehole.

28. The system of claim 27 further comprising a second filter that is coupled to the second riser pipe, wherein the first filter and the second filter are positioned within the borehole at different depths from one another.

29. The system of claim 27 wherein the central pipe is fixed relative to the borehole while guiding movement of the centralizer.

30. The system of claim 27 wherein the central pipe is movable relative to the borehole while guiding movement of the first filling material.

31. A system for monitoring a fluid within a borehole having a wall, the system comprising:

a first riser pipe positioned within the borehole;

a first filter coupled to the first riser pipe;

a first water permeable filling material;

a centralizer that is secured to the first riser pipe;

a central pipe positioned within the borehole, the central pipe guiding movement of the first filling material relative to the first filter, the central pipe guiding movement of the centralizer to position the first riser pipe within the borehole; and a substantially non-permeable second filling material that moves through the central pipe to fill a space between a wall of the borehole and the first riser pipe.

32. A system for monitoring a fluid within a borehole having a wall, the system comprising:

a first riser pipe positioned within the borehole;

a first filter coupled to the first riser pipe;

a first filling material;

a centralizer that is secured to the first riser pipe; and a central pipe positioned within the borehole, the central pipe guiding movement of the first filling material relative to the first filter, the central pipe guiding movement of the centralizer to position the first riser pipe within the borehole;

a sensor isolation tip; and an O-ring positioned on the sensor isolation tip, the O-ring selectively forming a water-tight seal between the sensor isolation tip and an inner wall of the first riser pipe.

33. The system of claim 32 further comprising a sensor that is positioned adjacent to the sensor isolation tip.

34. The system of claim 32 further comprising a rigid sample return line that is coupled to the sensor isolation tip, the sample return line being adapted to push the sensor isolation tip and the O-ring relative to the first riser pipe to form the water-tight seal.

35. A system for monitoring a fluid within a borehole having a wall, the system comprising:

a first riser pipe positioned at an angle that is at least 90 degrees relative to vertical within the borehole;

a first filter coupled to the first riser pipe;

a first filling material;

a centralizer that is secured to the first riser pipe; and a central pipe positioned within the borehole, the central pipe guiding movement of the first filling material relative to the first filter, the central pipe guiding movement of the centralizer to position the first riser pipe within the borehole.

36. A system for monitoring a fluid within a borehole having a wall, the system comprising:

a riser pipe positioned within the borehole;

a filter coupled to the riser pipe;

a filling material;

a centralizer that is coupled to the riser pipe; and a central pipe positioned within the borehole, the central pipe guiding movement of (i) the filling material relative to the filter, and (ii) the centralizer to position the riser pipe within the borehole;

wherein the centralizer is positioned at least partially around the central pipe and the centralizer moves along the central pipe.

37. The system of claim 36 further comprising a second filling material that is different than the first filling material, the second filling material moving through the central pipe to fill a space between a wall of the borehole and the first riser pipe.

38. The system of claim 36 wherein the central pipe is fixed relative to the borehole while guiding movement of the centralizer.

39. A method for monitoring a fluid within a borehole, the method comprising the steps of:

coupling a plurality of riser pipes to a centralizer;

moving the centralizer along a central pipe to guide movement of the riser pipe within the borehole; and moving a filling material through the central pipe to fill a space adjacent to a wall of the borehole.

* * * * *